US005160799A

United States Patent [19]

Tozuka et al.

[11] Patent Number: 5,160,799

[45] Date of Patent: Nov. 3, 1992

[54] ELECTRONIC MUSICAL INSTRUMENT

[75] Inventors: Akira Tozuka; Yasushi Kurakake; Kotaro Mizuno, all of Hamamatsu, Japan

[73] Assignee: Yamaha Corporation, Hamamatsu, Japan

[21] Appl. No.: 821,226

[22] Filed: Jan. 16, 1992

[30] Foreign Application Priority Data

Jan. 1, 1991 [JP] Japan ..... 3-004035

[51] Int. Cl.[5] ..... G10H 1/02; G10H 1/06; G10H 1/18

[52] U.S. Cl. ..... 84/653; 84/659; 84/662

[58] Field of Search ..... 84/615-620, 84/622-633, 653-665

[56] References Cited

U.S. PATENT DOCUMENTS 4,347,772 9/1982 Nishimoto .

*Primary Examiner*—Stanley J. Witkowski
*Attorney, Agent, or Firm*—Graham & James

[57] ABSTRACT

There is provided an electronic musical instrument capable of sounding plural musical tones, e.g., first and second musical tones, having different tone colors, to each of which the performer can impart a different pitch-bend-effect independently. As a means for imparting the pitch-bend-effect, there is provided a wheel-type control. In addition, this system also provides first and second modes. In the first mode, different variation widths of pitch-bend-effects are respectively imparted to the first and second musical tones on the basis of the control input given by operating the wheel-type control. In the second mode, the same variation width of pitch-bend-effect is imparted to the first and second musical tones on the basis of the control input given by operating the wheel-type control.

6 Claims, 27 Drawing Sheets

(WHOLE CONFIGURATION OF ELECTRONIC MUSICAL INSTRUMENT)

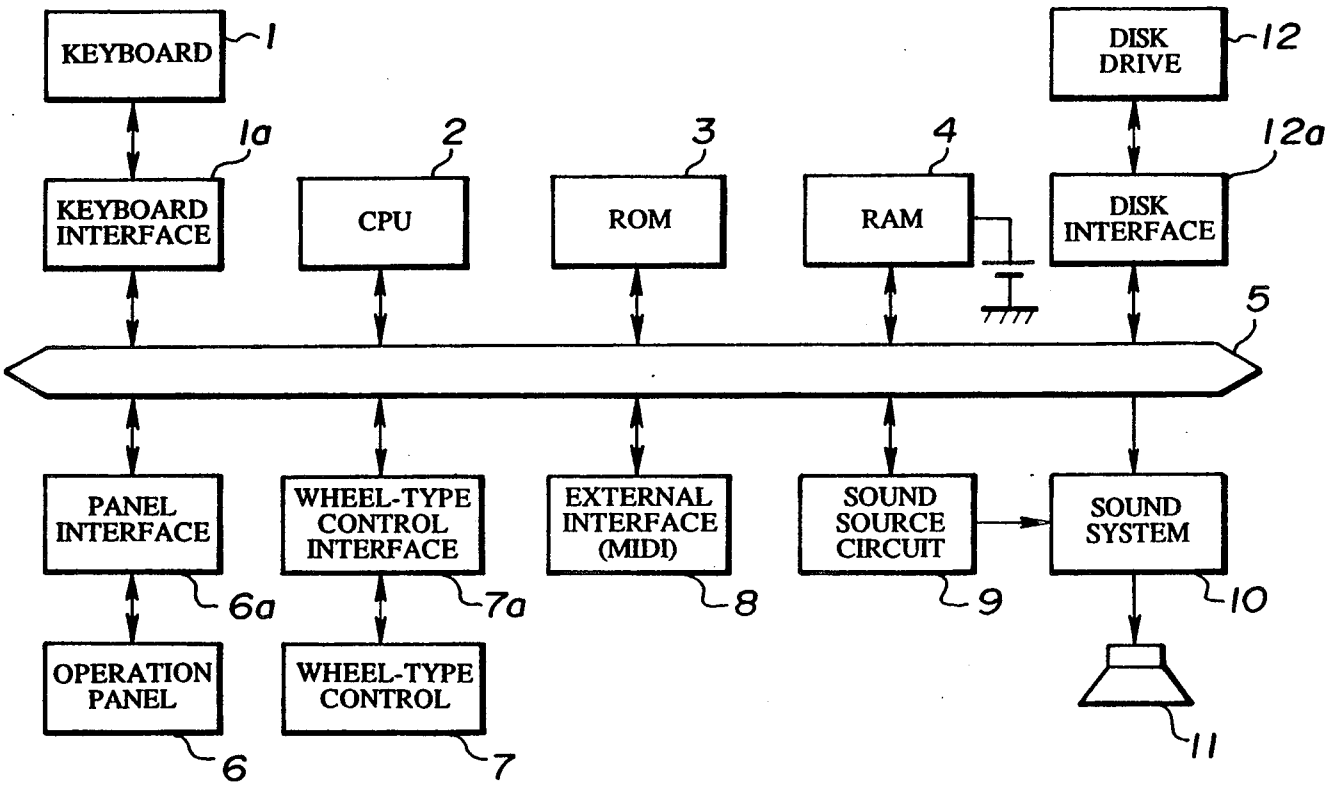
FIG. 1 (WHOLE CONFIGURATION OF ELECTRONIC MUSICAL INSTRUMENT)

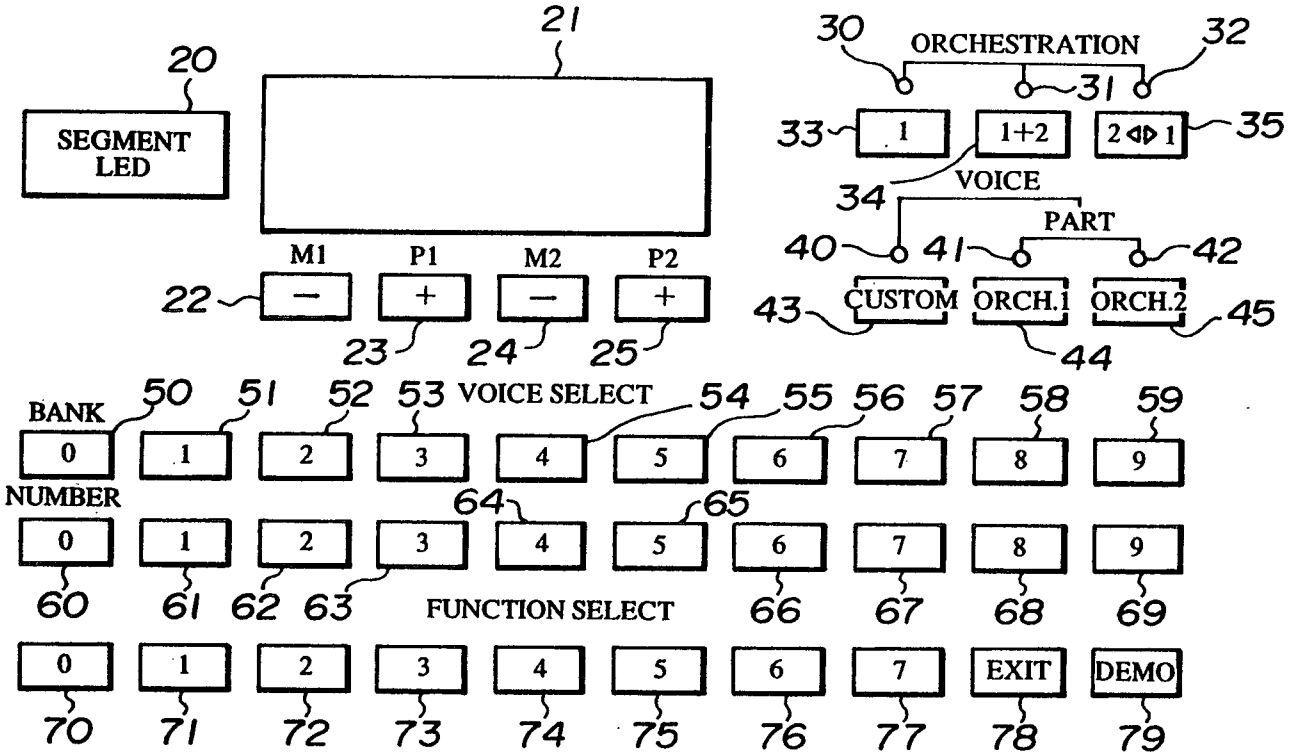
FIG. 2 (PANEL DESIGN OF OPERATION PANEL 6)

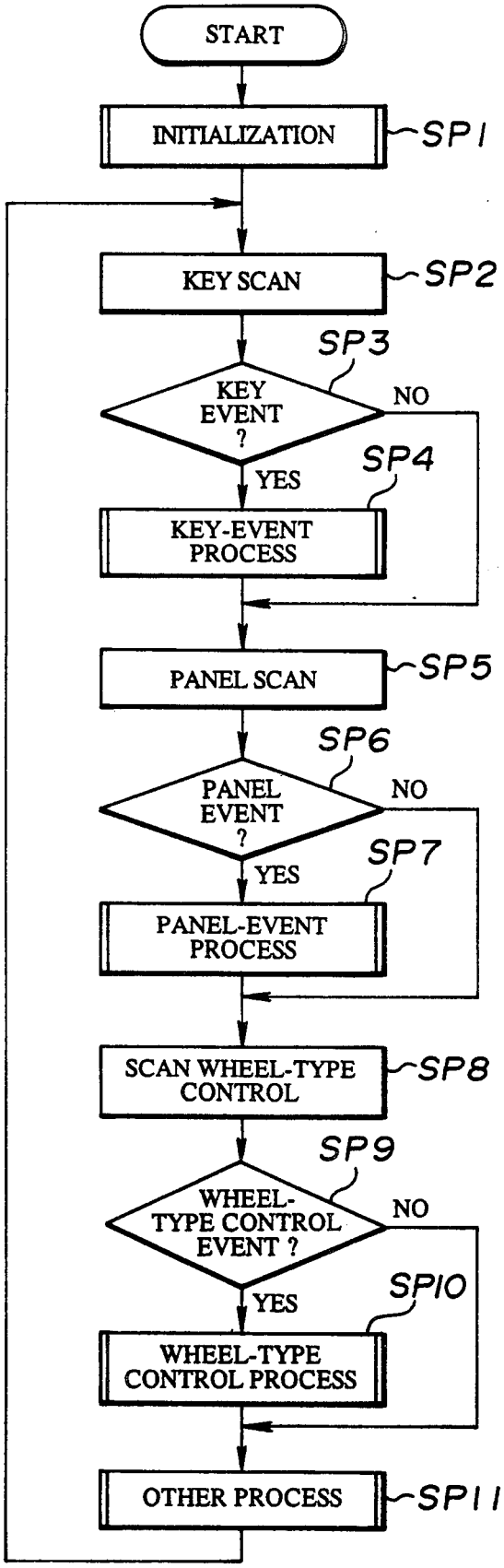
FIG. 3 (MAIN PROCESS ROUTINE)

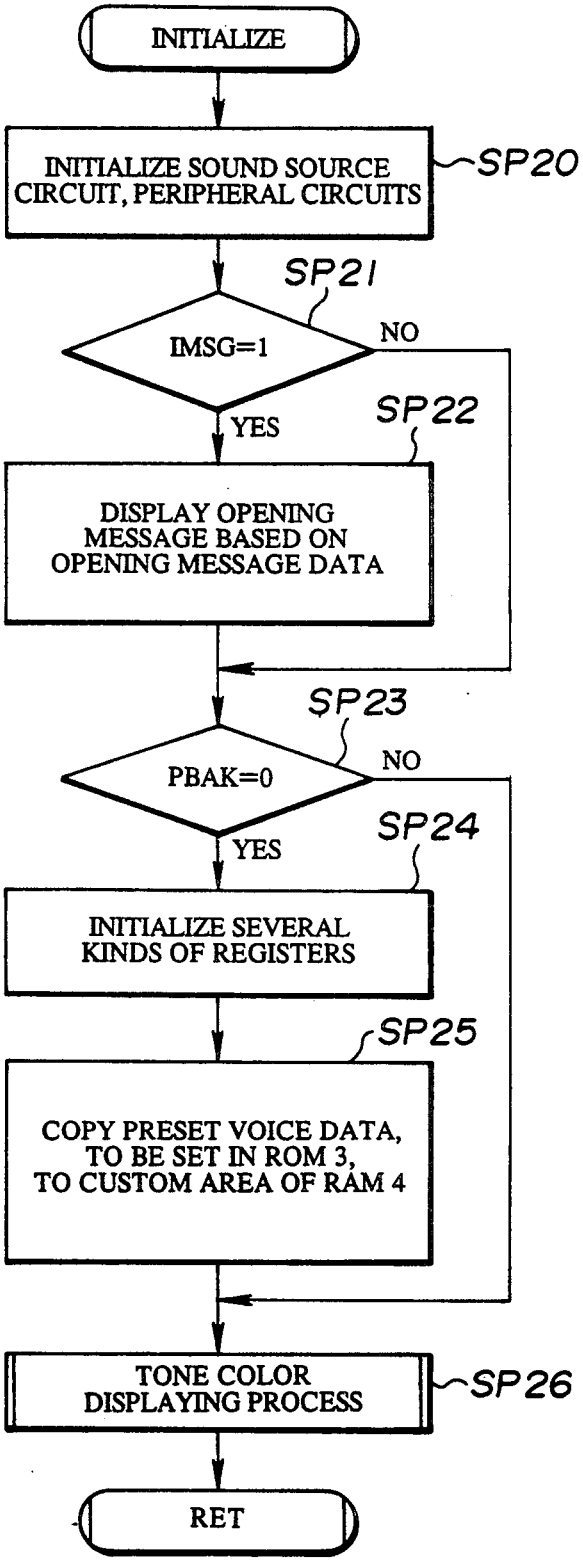
FIG.4 (INITIALIZATION PROCESS ROUTINE)

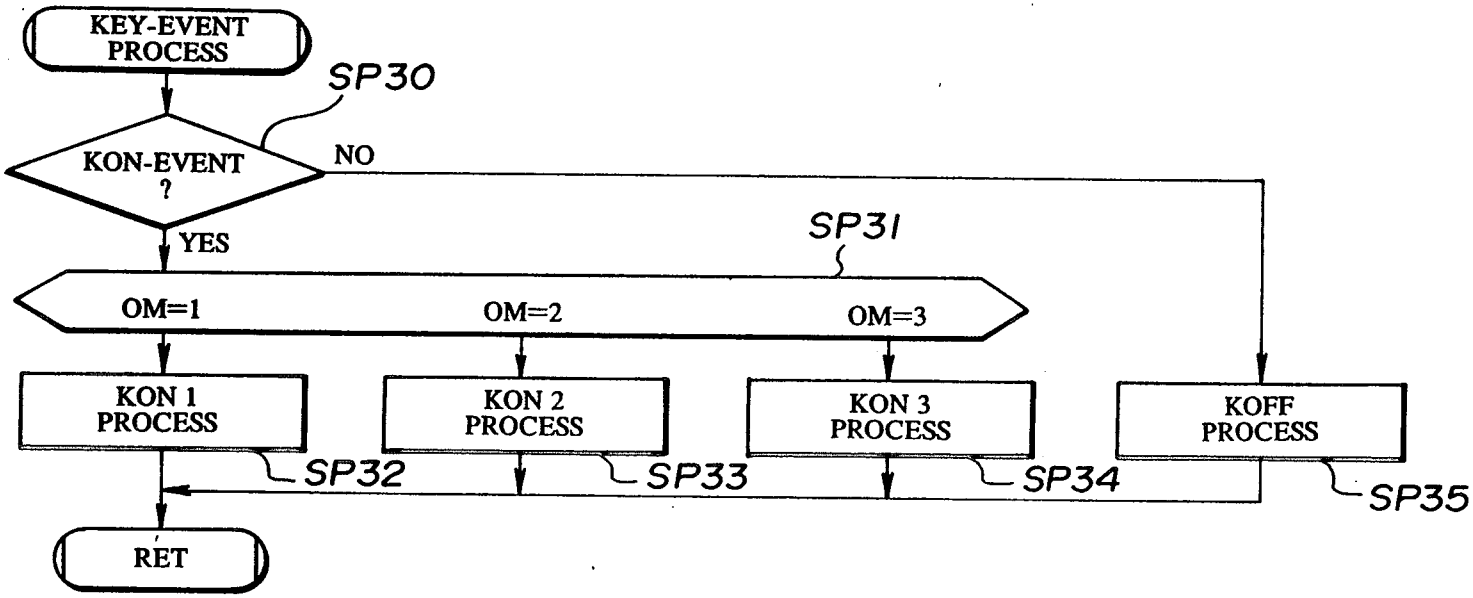
FIG. 5 (KEY-EVENT PROCESS ROUTINE)

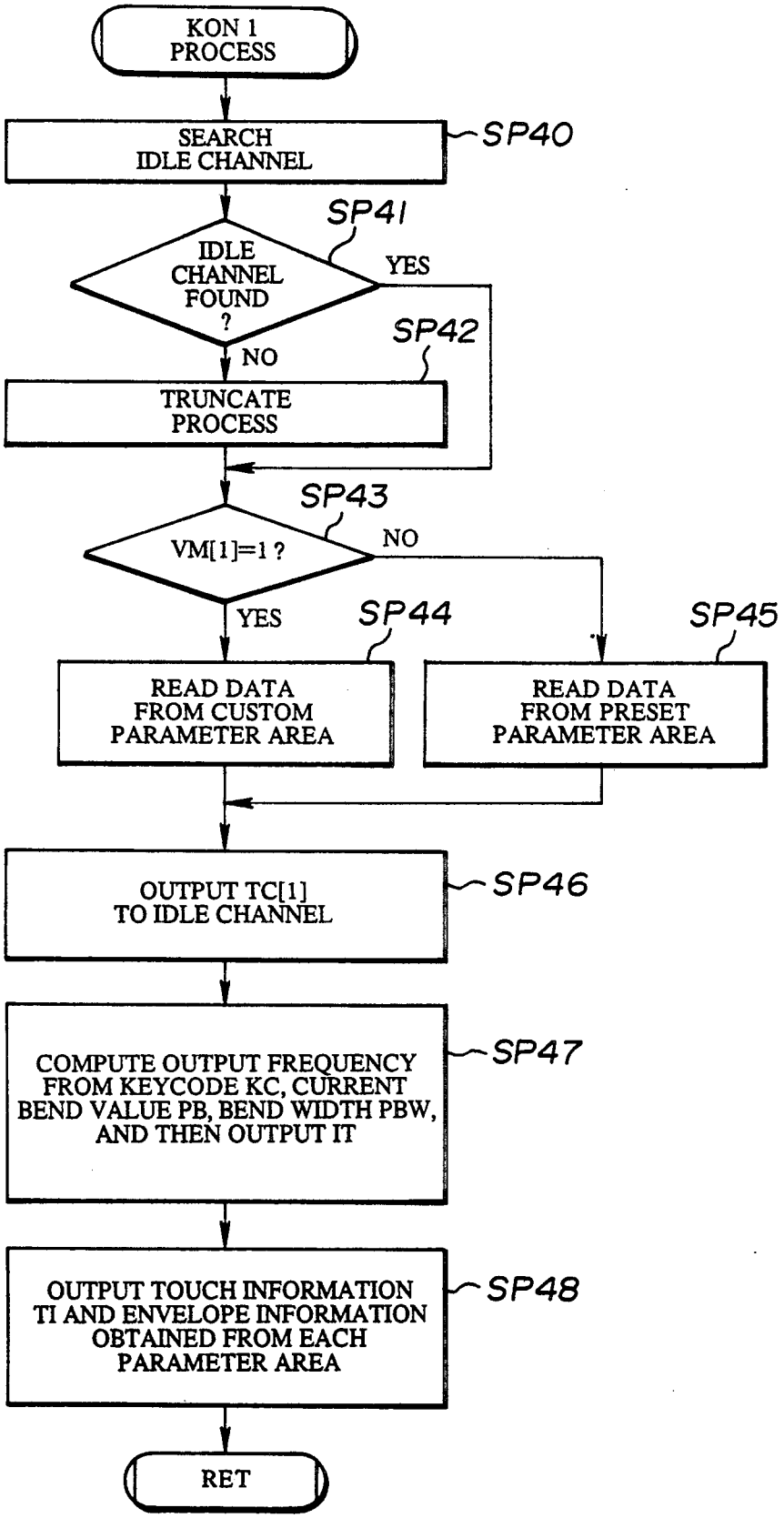
FIG. 6 (KON 1 PROCESS ROUTINE)

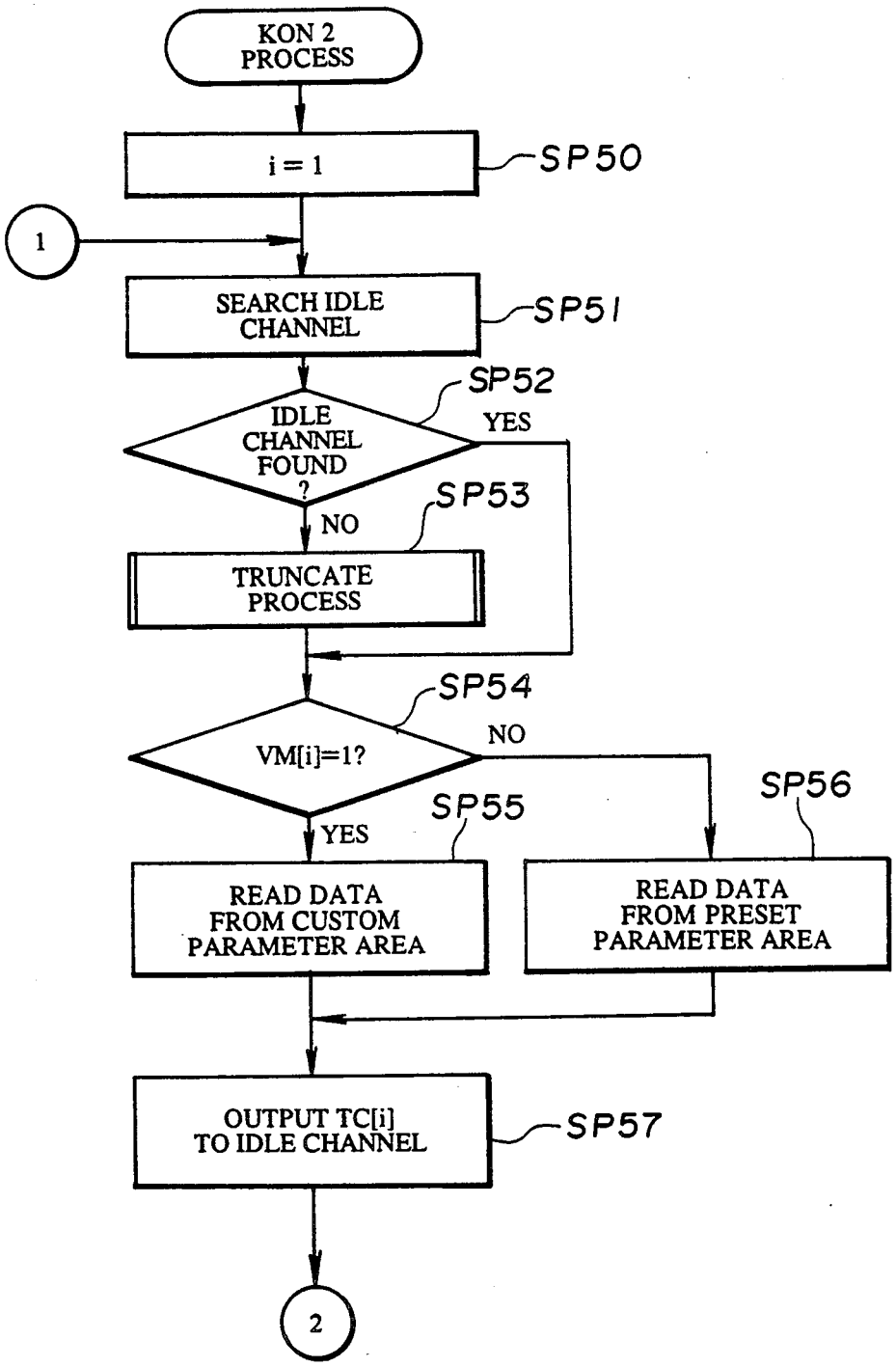
FIG. 7 (KON 2 PROCESS ROUTINE)

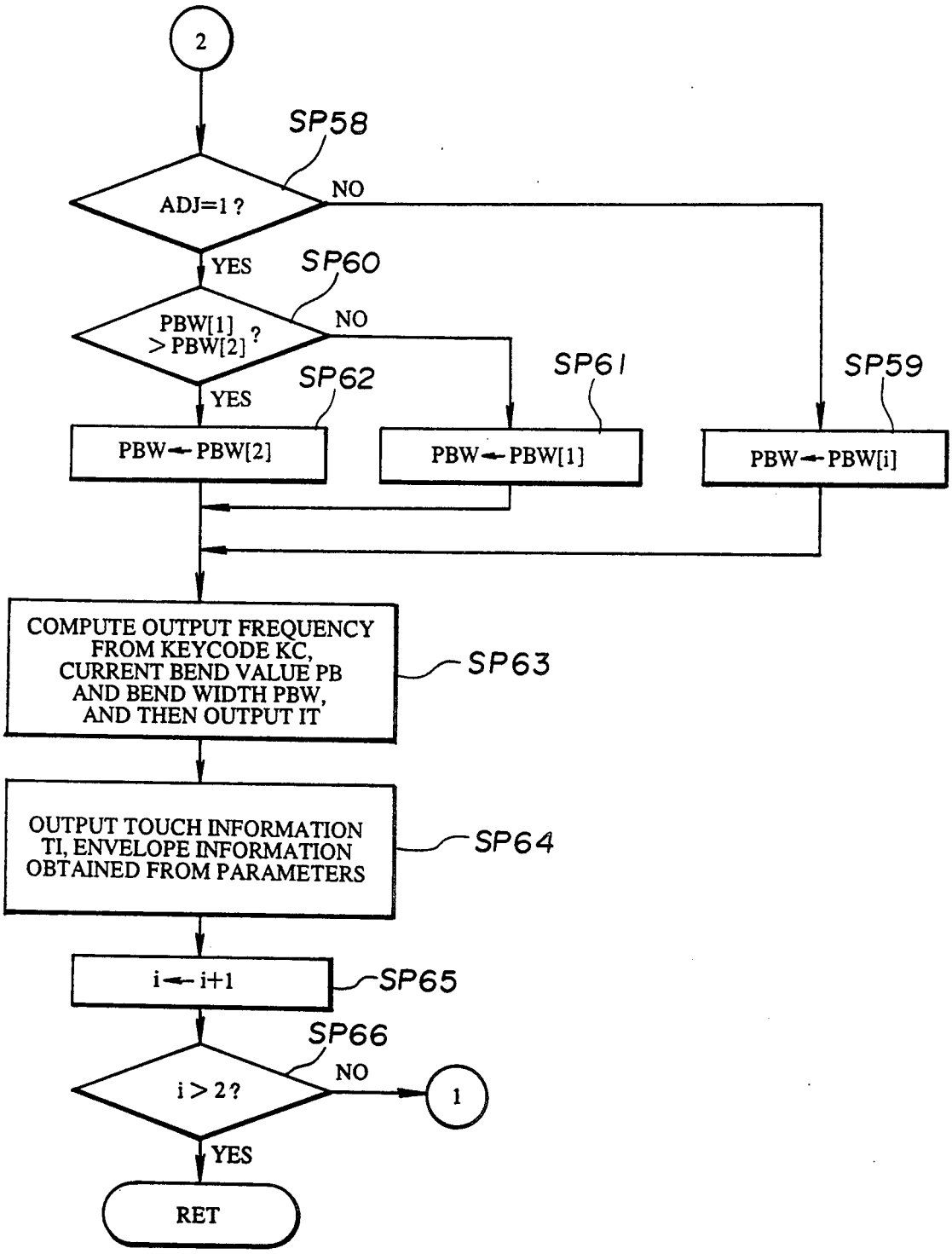
FIG. 8 (KON 2 PROCESS ROUTINE)

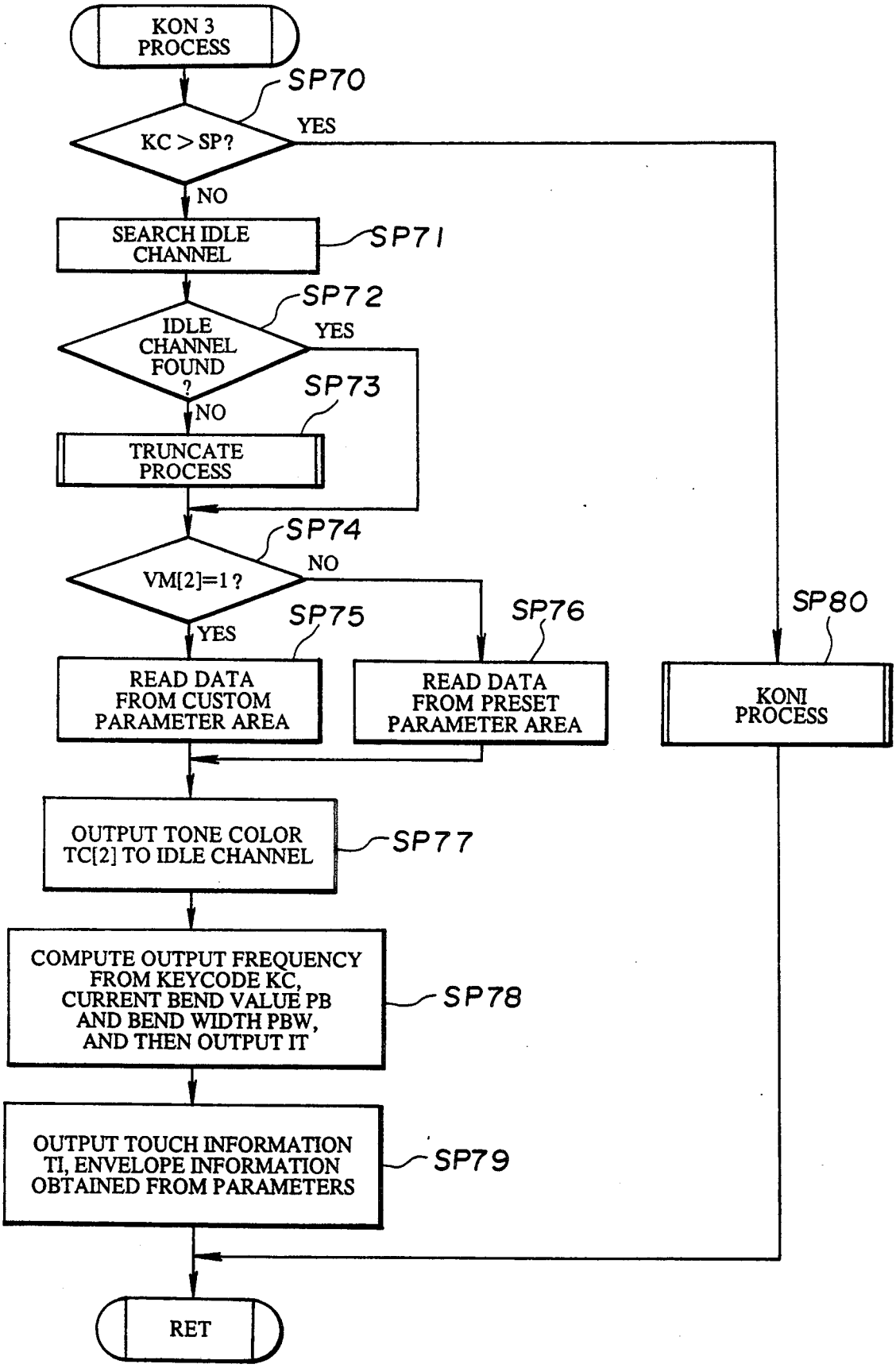
FIG. 9 (KON 3 PROCESS ROUTINE)

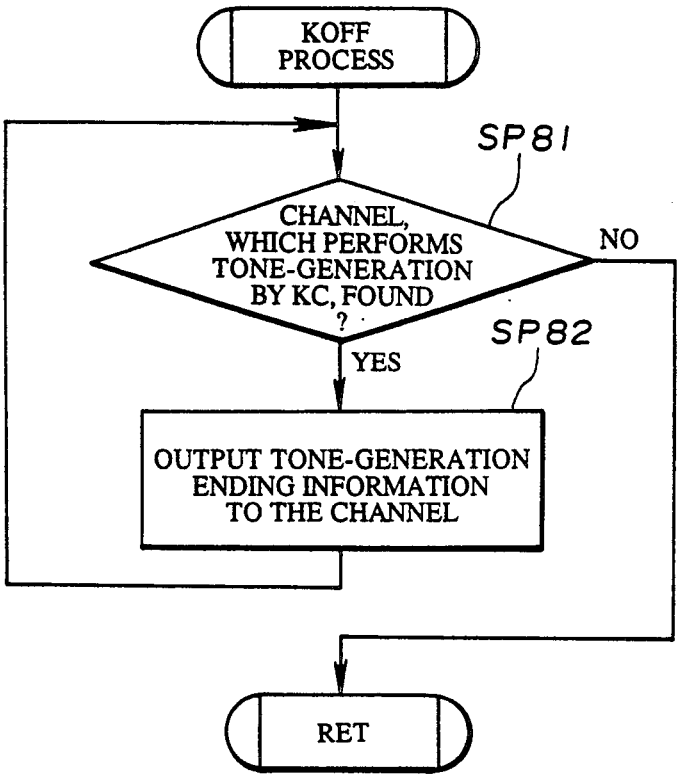
FIG.10 ( KOFF PROCESS ROUTINE )

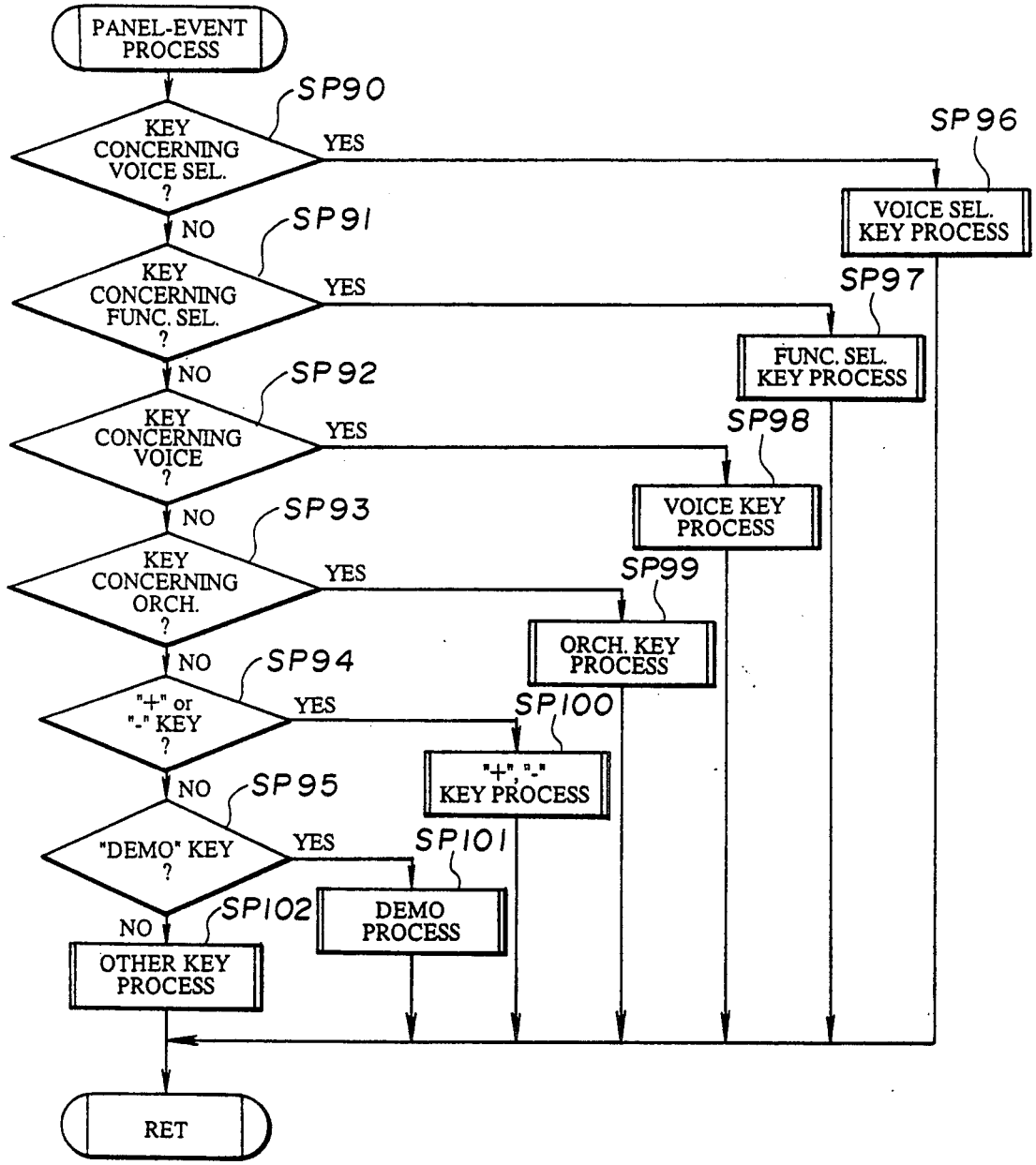
FIG.11 (PANEL-EVENT PROCESS ROUTINE)

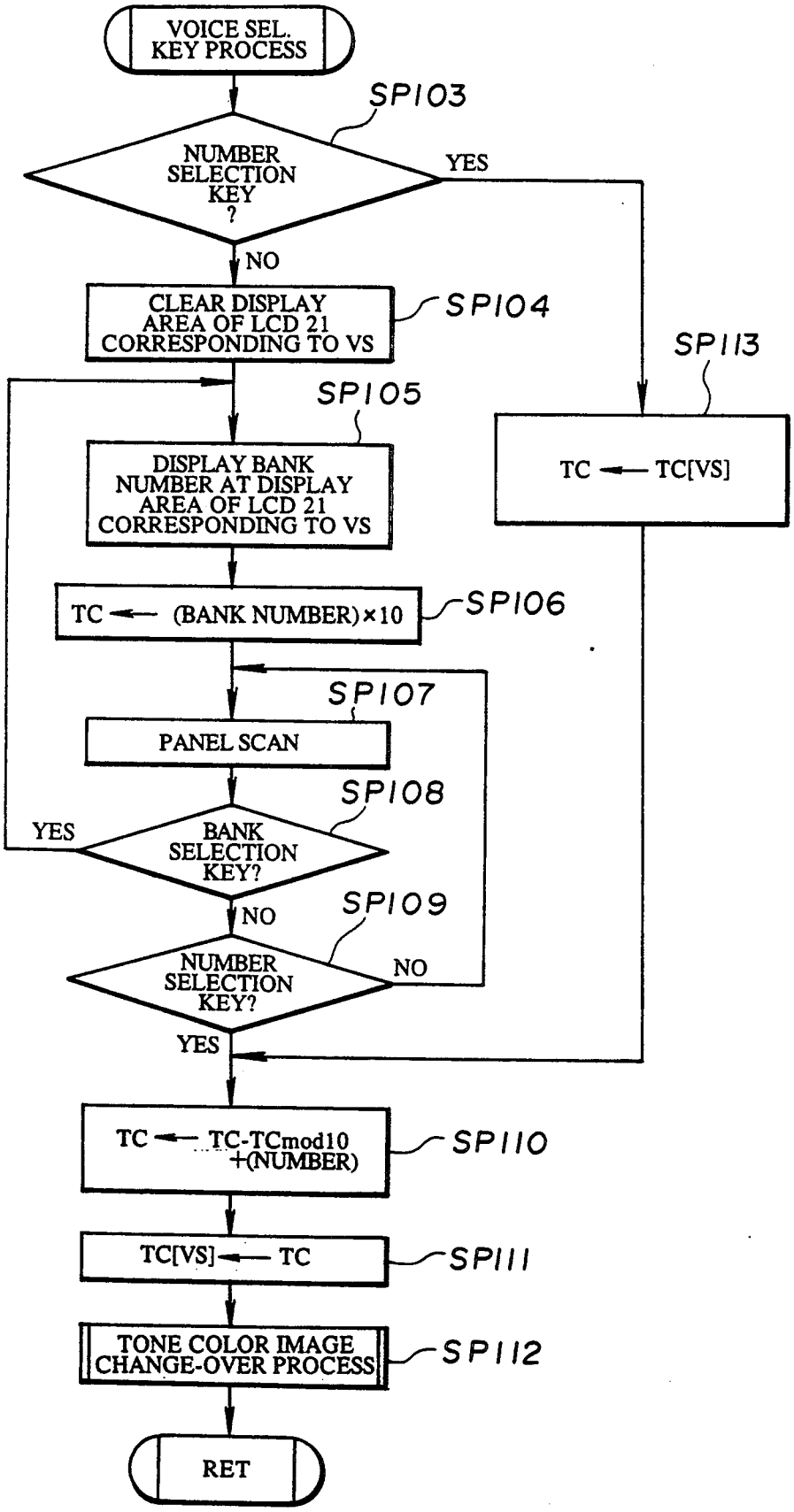
FIG.12 (VOICE SEL. KEY PROCESS)

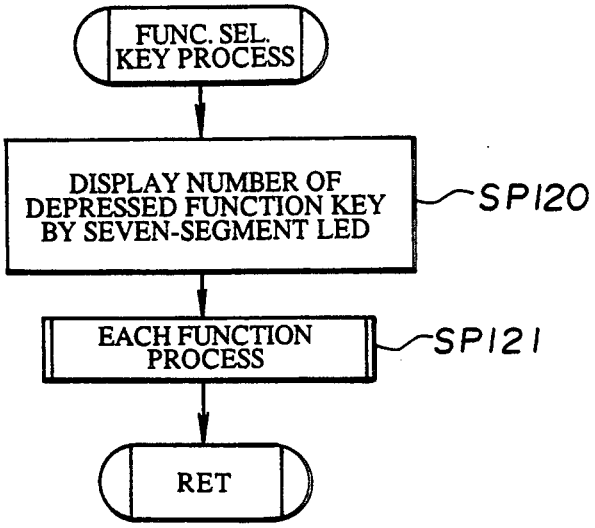
FIG.13 (FUNCTION SEL. KEY PROCESS)
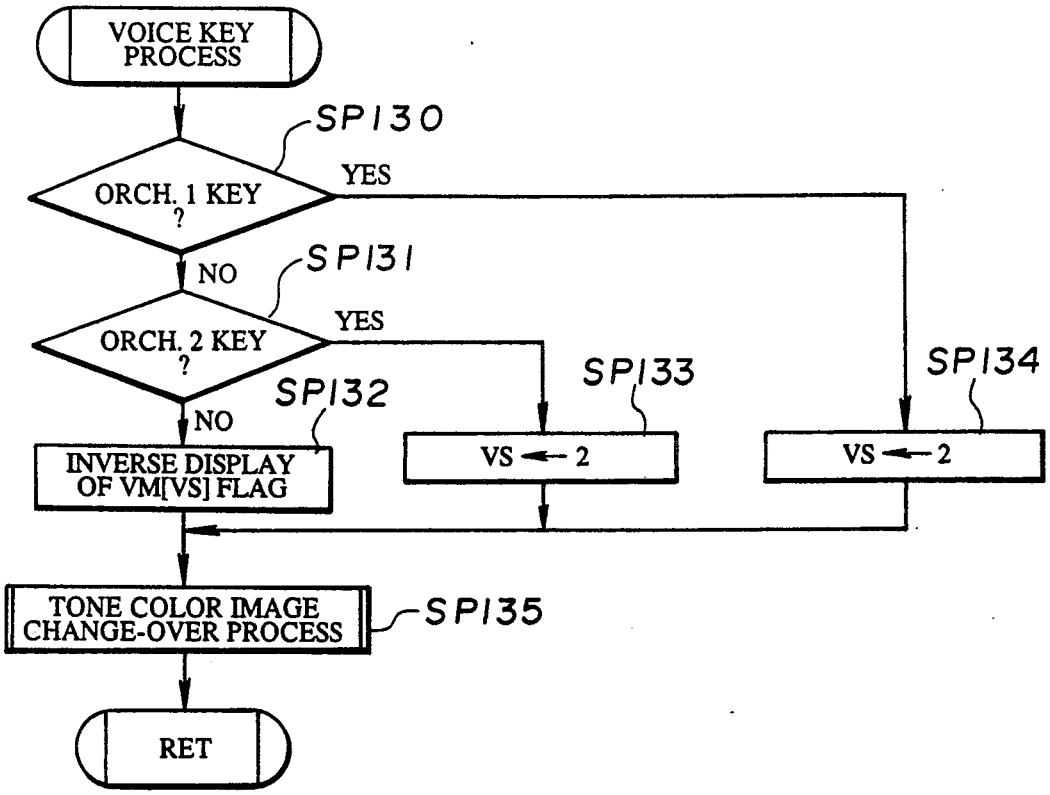
FIG.14 (VOICE KEY PROCESS)

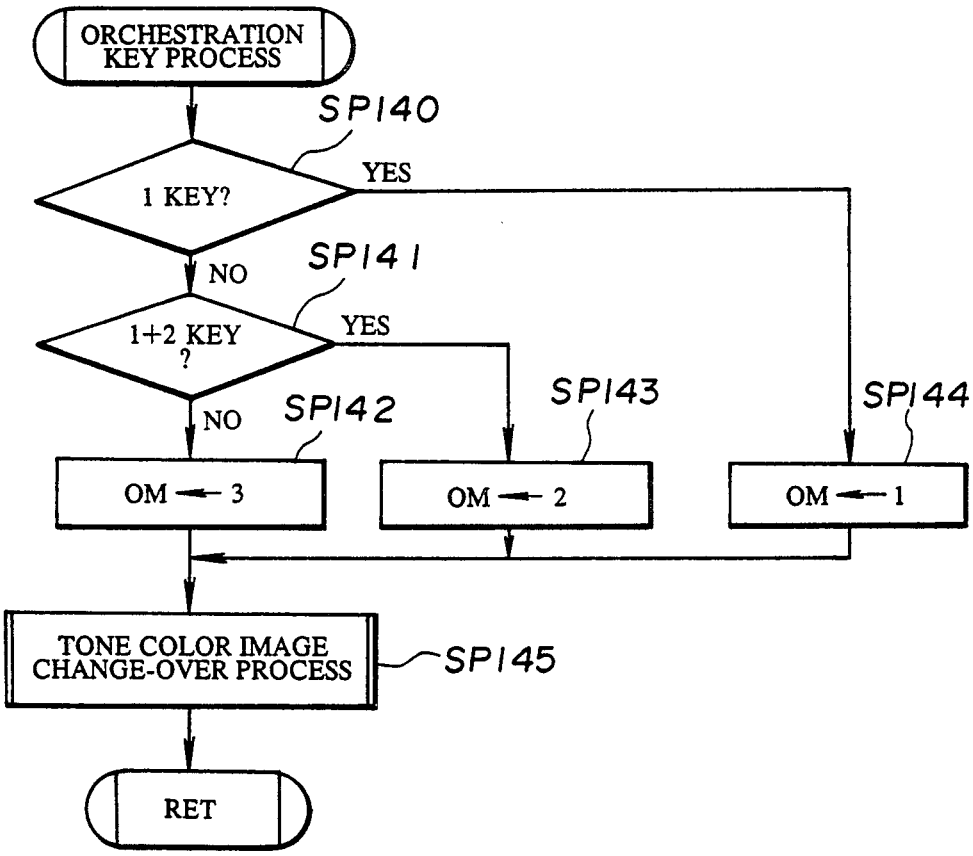
FIG.15 (ORCHESTRATION KEY PROCESS)

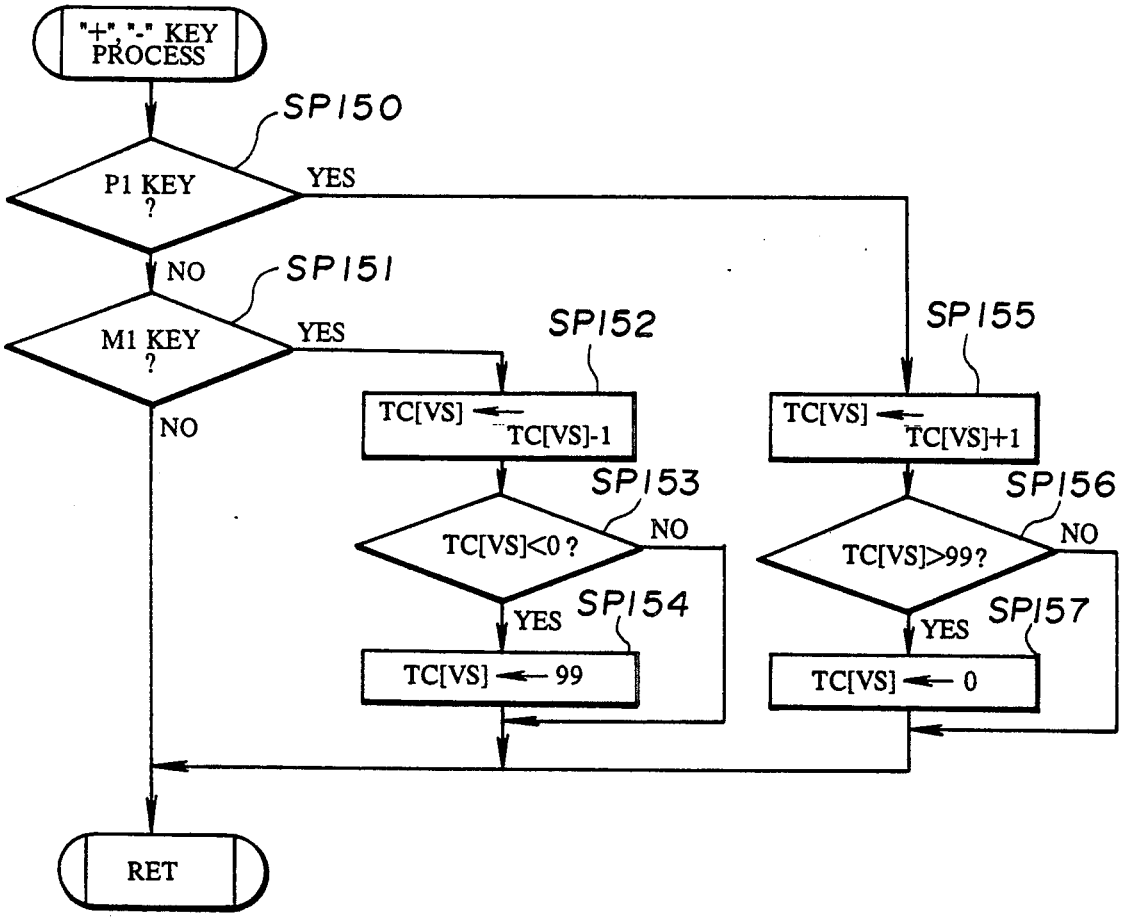
FIG. 16 ("+", "-" KEY PROCESS ROUTINE)

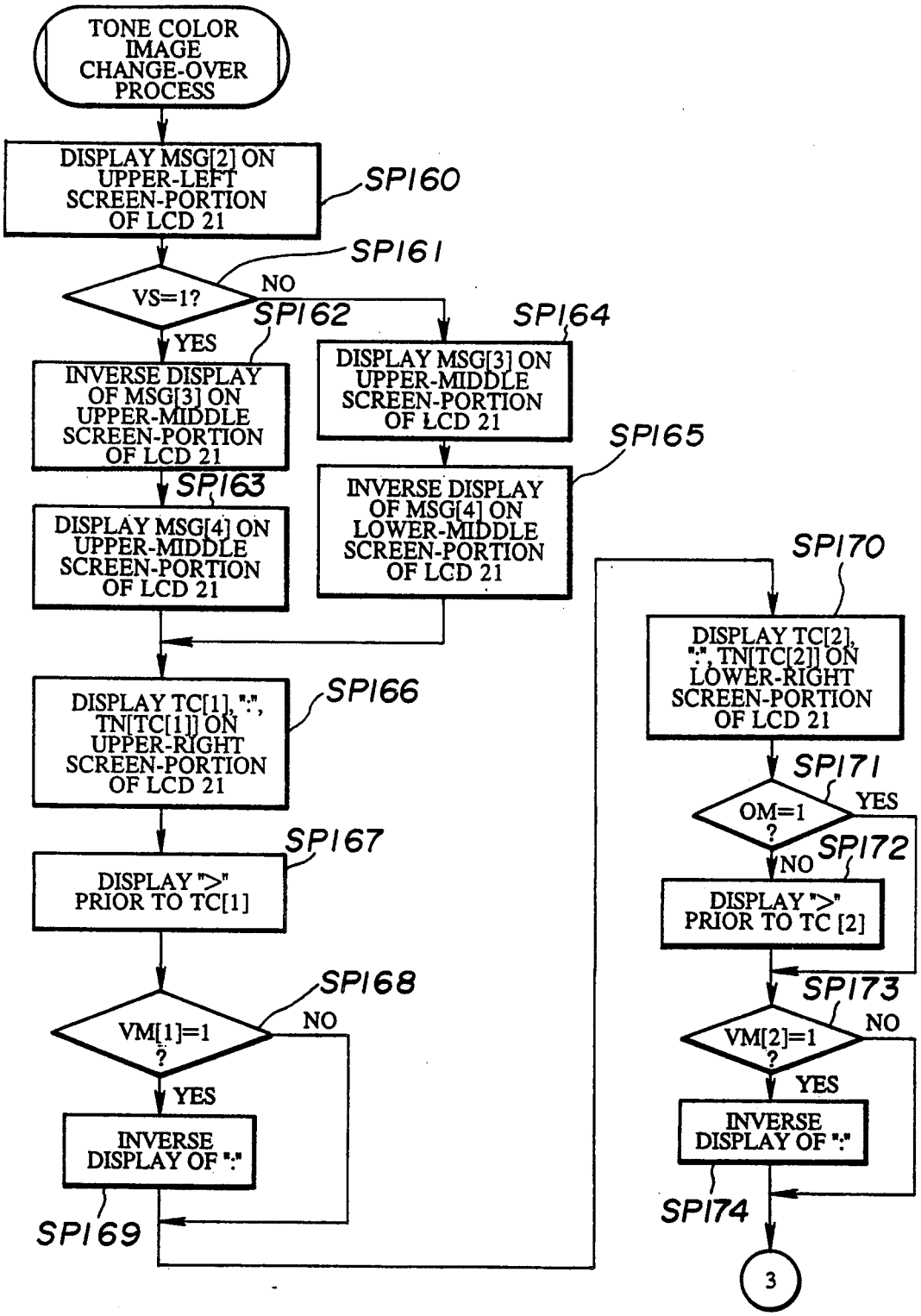
FIG.17 (TONE COLOR IMAGE CHANGE-OVER PROCESS)

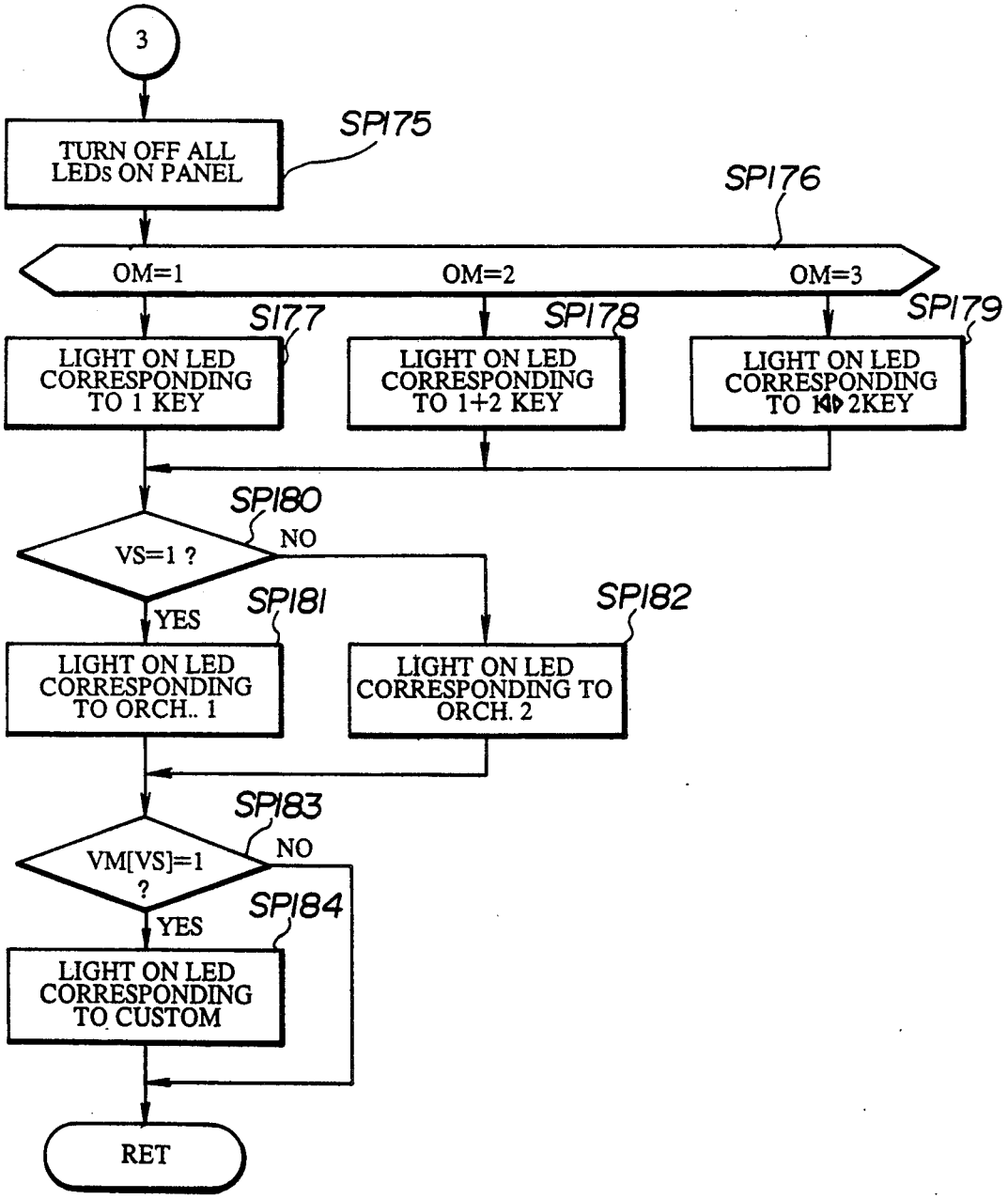
FIG.18 (TONE COLOR IMAGE CHANGE-OVER PROCESS)

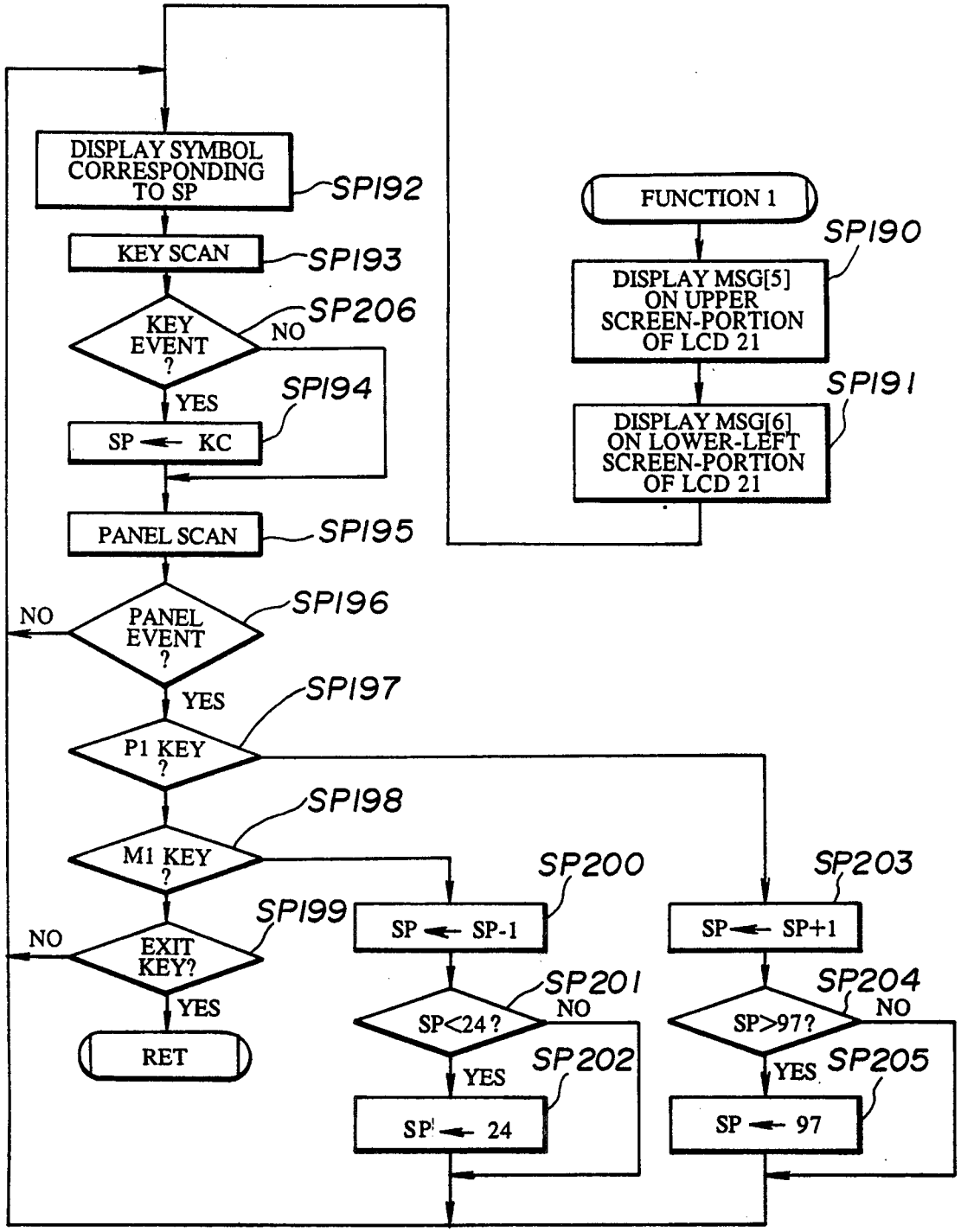
FIG. 19 (FUNCTION 1 PROCESS ROUTINE)

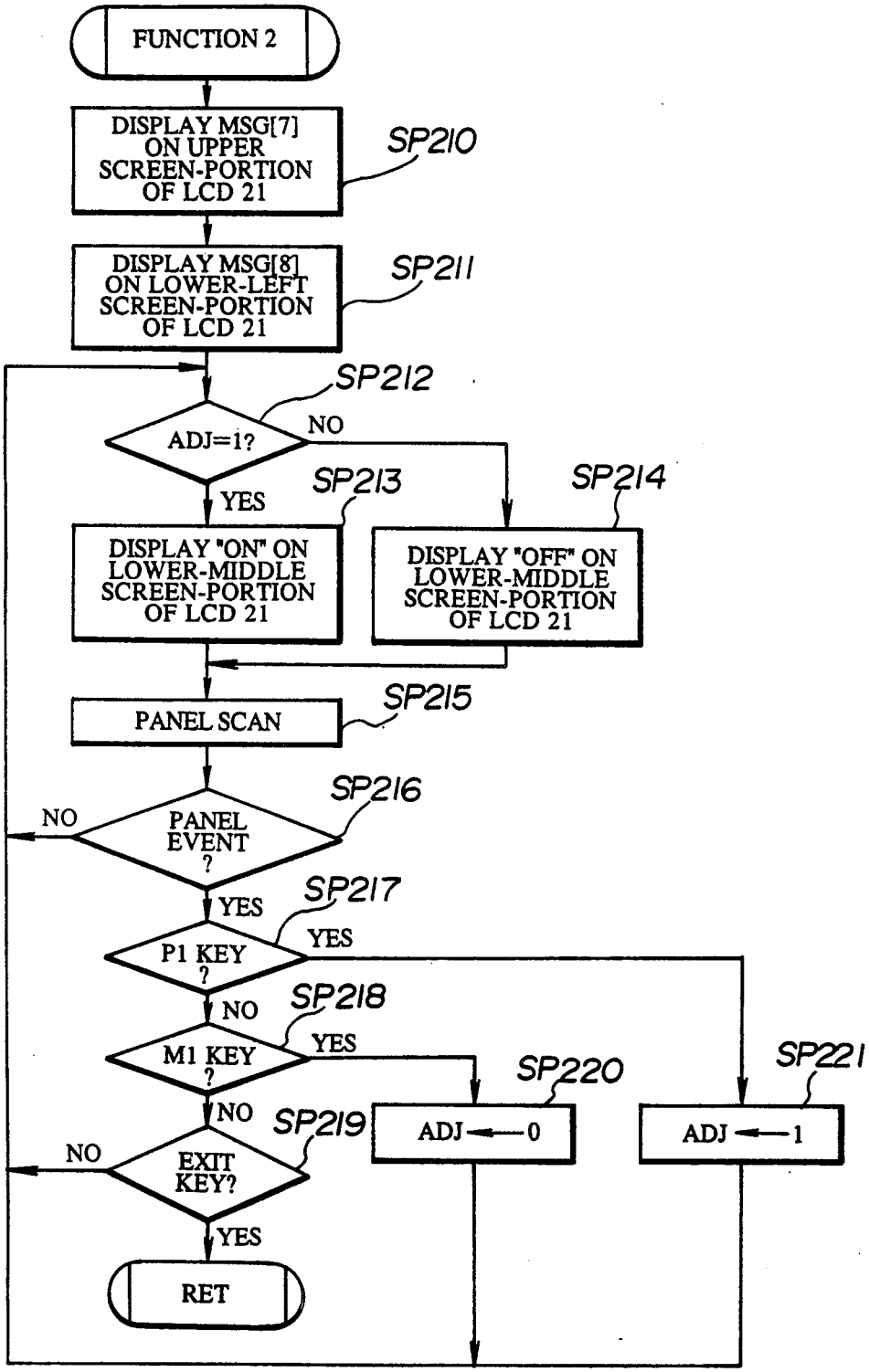
FIG. 20 (FUNCTION 2 PROCESS ROUTINE)

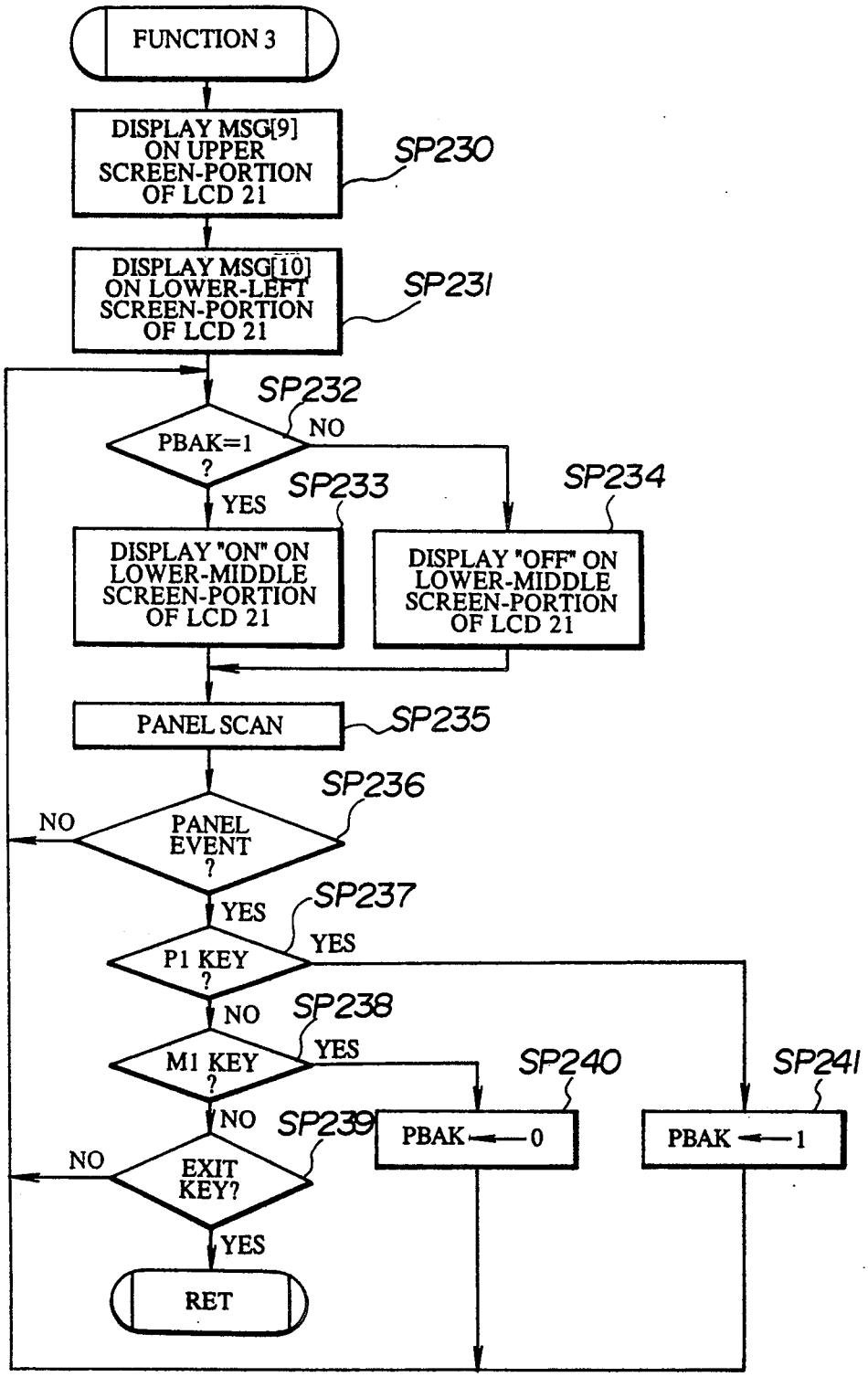
FIG. 21 (FUNCTION 3 PROCESS ROUTINE)

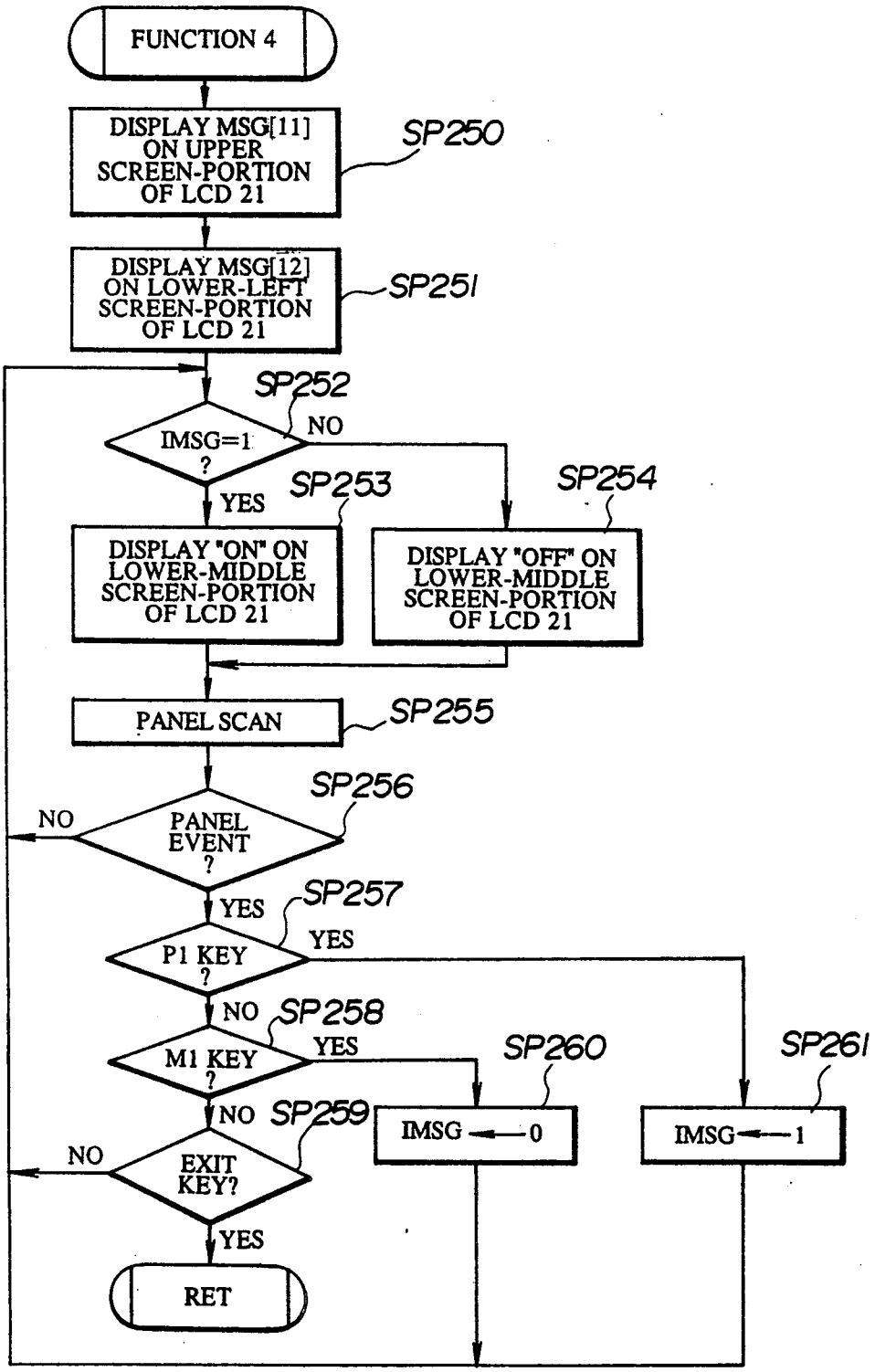
FIG. 22 (FUNCTION 4 PROCESS ROUTINE)

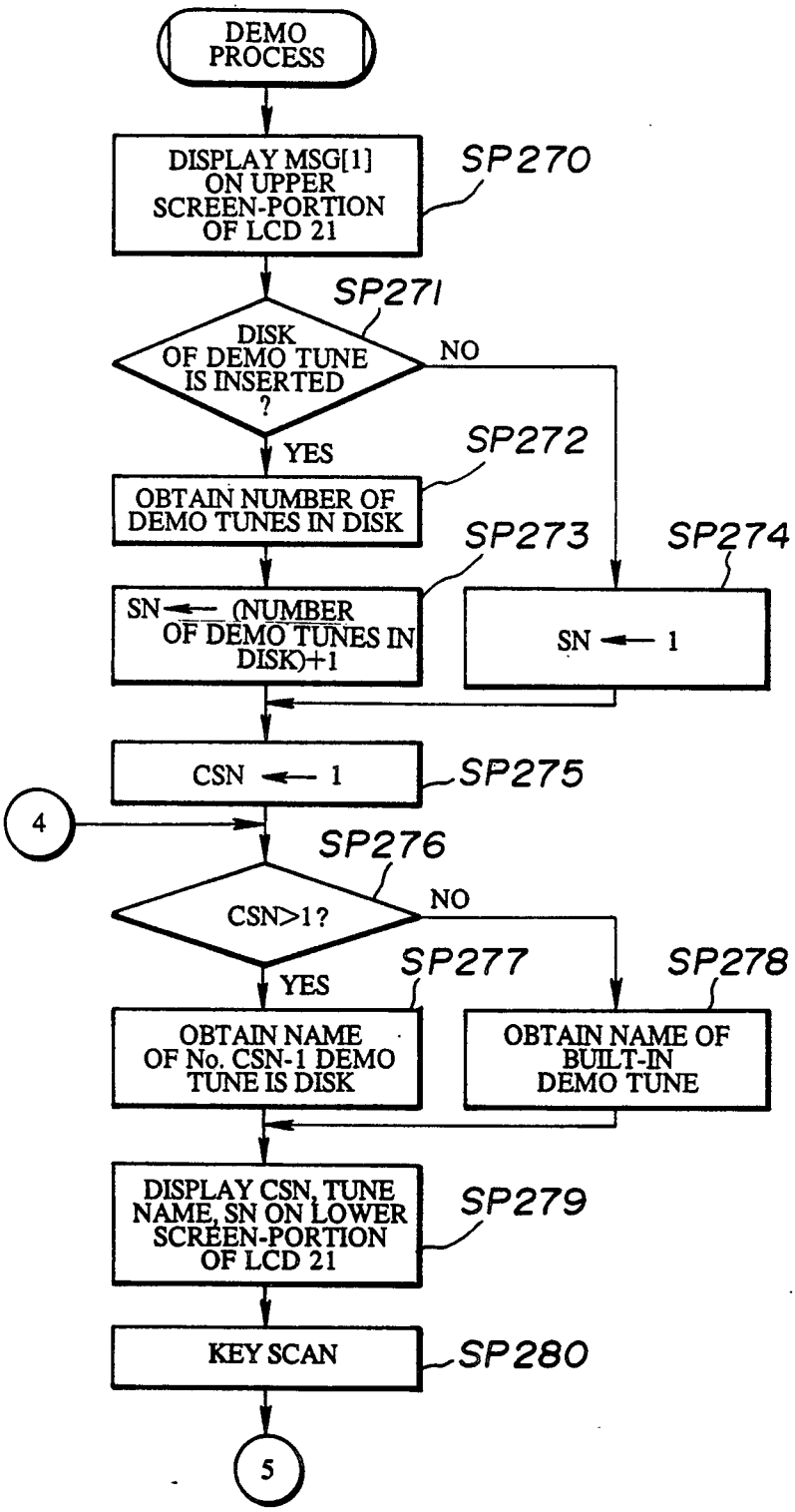
FIG. 23 (DEMO PROCESS ROUTINE)

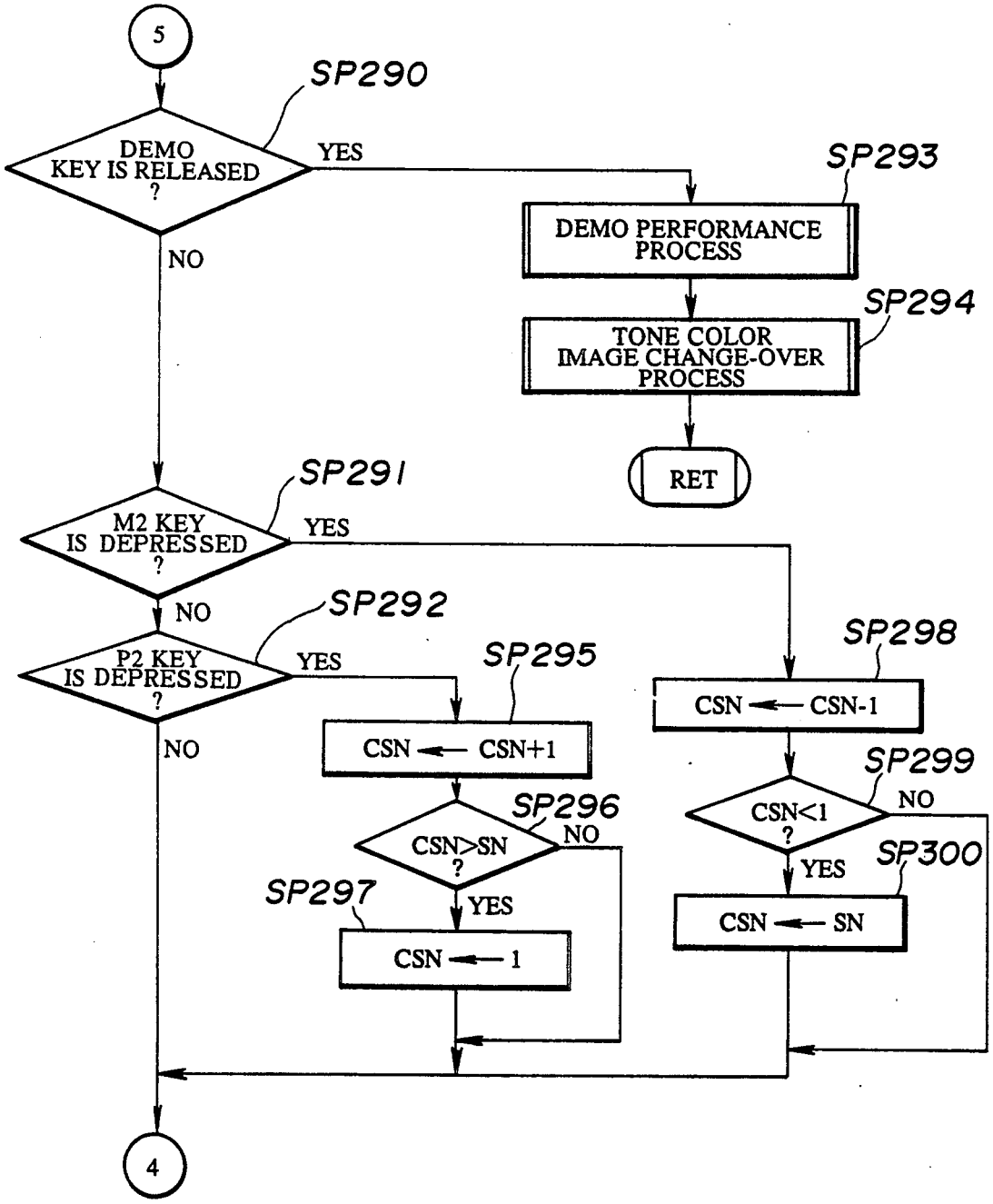
FIG. 24 (DEMO PROCESS ROUTINE)

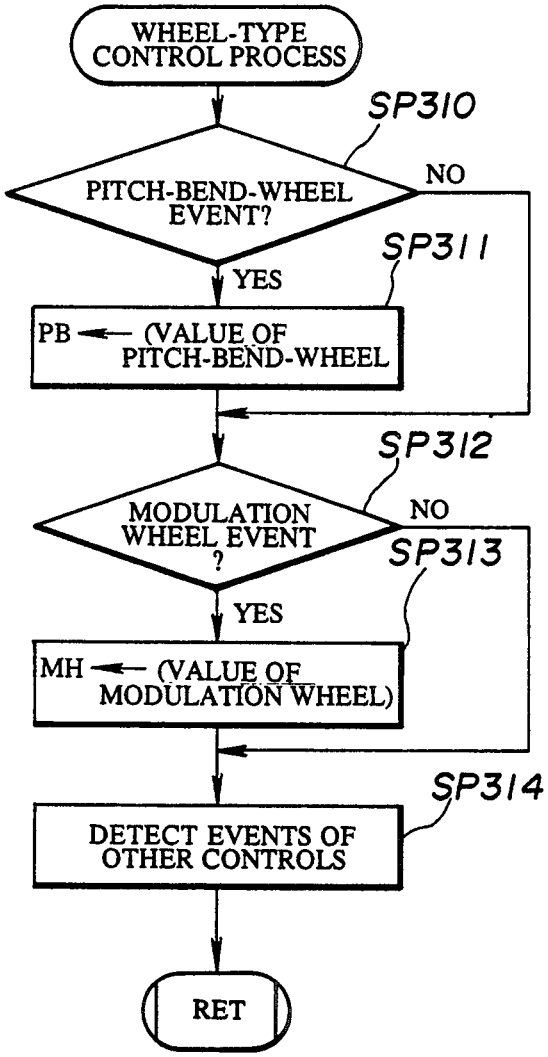
FIG. 25 (WHEEL-TYPE CONTROL PROCESS ROUTINE)

| i | MSG[i] |
|---|---|
| 1 | DEMONSTRATION |
| 2 | VOICE |
| 3 | ORCH.1 |
| 4 | ORCH.2 |
| 5 | SPLIT POINT |
| 6 | Split= |
| 7 | PITCH BEND SELECT |
| 8 | Adjust= |
| 9 | MEMORY BACK UP |
| 10 | Back Up= |
| 11 | INITIAL MESSAGE |
| 12 | Message= |

FIG. 26 (OUTPUT MESSAGE TABLE)

| TONE COLOR NAME |
| --- |
| PITCH-BEND INFORMATION |
| MODULATION INFORMATION |
| ENVELOPE INFORMATION |
| DE-TUNE INFORMATION |
| |

PRESET (ROM)

| TONE COLOR NAME |
| --- |
| PITCH-BEND INFORMATION |
| MODULATION INFORMATION |
| ENVELOPE INFORMATION |
| DE-TUNE INFORMATION |
| |

CUSTOM (RAM)

FIG. 27 (VOICE INFORMATION TABLE)

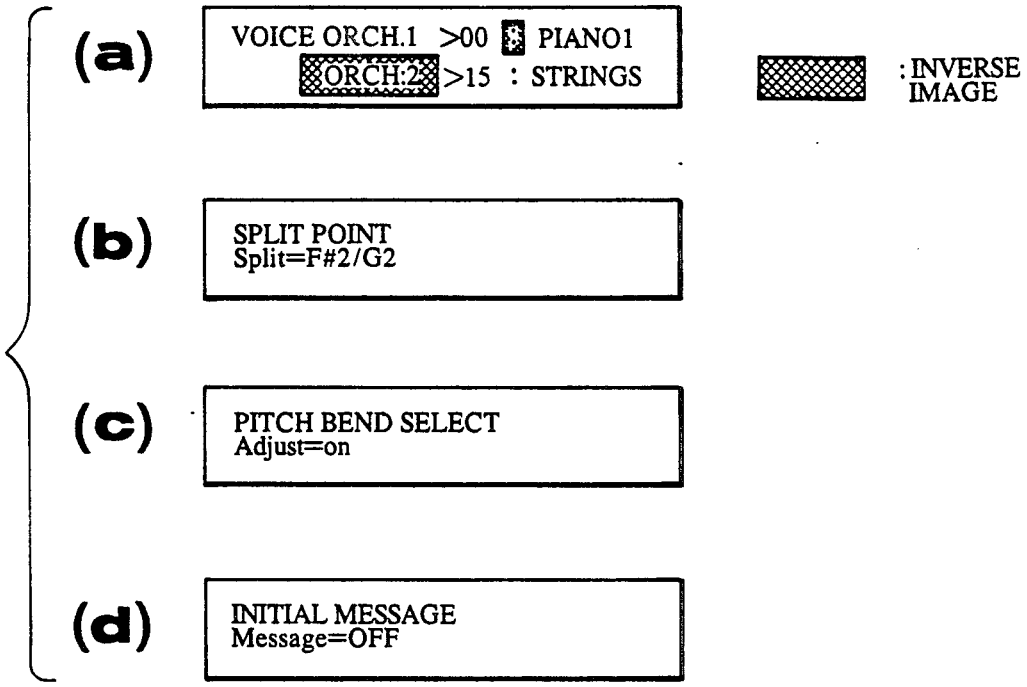
FIG.28 (EXAMPLES OF DISPLAY IMAGES)

ELECTRONIC MUSICAL INSTRUMENT

BACKGROUND OF THE INVENTION

1. Field of the Invention

The present invention relates to an electronic musical instrument which can simultaneously generate a plurality of musical tones having different tone colors.

2. Prior Art

Conventionally, the electronic musical instrument capable of simultaneously generating plural series of musical tones provides a pitch control by which pitch of the musical tone can be varied. Japanese Patent Laid-Open Publication No. 62-186293 discloses one of the above-mentioned electronic musical instruments in which, responsive to the operation of the pitch control, pitch of the musical tone is varied in response to the maximum pitch-variation-width, wherein this width is set for each series of musical tones in advance.

In the above-mentioned electronic musical instrument, when the pitch control is operated under the state where the different pitch-variation widths are respectively set for plural series of musical tones, the pitch must be varied in different pitch-variation width in each series of musical tones. Therefore, in case of the performer who is familiar with the operation of the above-mentioned electronic musical instrument, it is possible to shift the musical interval to cause the chord by merely operating a single pitch control, or it is also possible to slightly shift the pitch to cause the de-tune effect, which is an effect of changing the generating tone pitch slightly. However, in case of the performer who is not accustomed to the operation, it is not possible to bring the expected same pitch variation upon plural series of musical tones, or many edit operations must be required in order to bring all of the pitch variations of the musical tones into unify, which is disadvantageous.

SUMMARY OF THE INVENTION

It is accordingly a primary object of the present invention to provide an electronic musical instrument which can generate the varied musical tones by varying the different musical tone parameters in each of plural series of musical tones.

It is another object of the present invention to provide an electronic musical instrument which can simplify its operation according to the needs of the performer.

In an aspect of the present invention, there is provided an electronic musical instrument comprising: a first musical tone signal generating means for generating a first musical tone signal; a second musical tone signal generating means for generating a second musical tone signal; a control, which can be operated by a performer, to which values can be continuously set; first and second maximum-parameter-variation setting means for setting maximum-parameter-variations, corresponding to the maximum value which can be set by the control, for the first and second musical tone generating means independently; and parameter designating means for designating musical tone parameters of the first and second musical tone generating means on the basis of the value set by the control and the maximum-parameter-variations which are respectively set for the first and second musical tone generating means. Herein, there is provided first and second modes, one of which can be arbitrarily selected by the parameter designating means. In the first mode, the parameter designating means sets the musical tone parameter of the first musical tone signal generating means on the basis of the maximum value set by the first maximum-parameter-variation setting means, while it also sets the musical tone parameter of the second musical tone signal generating means on the basis of the maximum value set by the second maximum-parameter-variation setting means. In the second mode, on the basis of one of the maximum values set by the first and second maximum-parameter-variation setting means which is selected by the predetermined condition, the parameter designating means sets the musical tone parameters of the first and second musical tone signal generating means.

When the first mode is selected by the parameter changing means, on the basis of the value set by the control and the maximum values respectively set by the first and second maximum-parameter-variation setting means, different musical tone parameters are applied for the first and second musical tone signals respectively. Thus, it is possible to obtain different parameter variations for both musical tones by use of a single control, which offers the varied performance operation.

On the other hand, when the second mode is selected by the parameter designating means, on the basis of the value set by the control and one of the maximum values respectively set by the first and second maximum-parameter-variation setting means, the same musical tone parameter is applied for both of the first and second musical tone signals. Therefore, it is unnecessary for the performer to pay attention to the difference between the musical tone parameters for the first and second musical tone signals.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 1 is a block diagram showing an electric configuration of an electronic musical instrument according to an embodiment of the present invention;

FIG. 2 illustrates a panel design of an operation panel shown in FIG. 1;

FIGS. 3 to 25 are flowcharts showing operations of the embodiment;

FIG. 26 is a drawing illustrating an output message table of a liquid crystal display (i.e., LCD) used in the embodiment;

FIG. 27 shows voice information tables; and

FIG. 28 shows examples of the displayed image of LCD.

DESCRIPTION OF THE PREFERRED EMBODIMENT

Now, description will be given with respect to an electronic musical instrument according to an embodiment of the present invention by referring to the drawings.

[A] Configuration of Embodiment

FIG. 1 is a block diagram showing an electric configuration of an electronic musical instrument according to an embodiment of the present invention, wherein 1 designates a keyboard on which plural keys to be performed by the performer are arranged. This keyboard 1 is designed to output the operation information representing the operation of each key, so that plural pieces of the operation information are sequentially outputted via a keyboard interface 1*a* and a bus 5. As similar to the keyboard output information of the known electronic musical instrument, this operation information contains a key-on pulse KON representing a key-depression event, a key-off pulse KOFF representing a key-release event, a keycode KC representing a pitch of the depressed key and touch information TI representing the key-depression intensity.

Meanwhile, 2 designates a central processing unit (i.e., CPU) which is configured to control other elements of this system based on the processing programs to be set in a read-only memory (i.e., ROM) 3.

Other than control programs, the ROM 3 also stores several kinds of data and tables which are required for the processings. By each tone color of the musical tone to be generated from the electronic musical instrument, it stores preset voice data representing envelope information of such tone color, or it stores performance information which is used for the performance demonstration, for example.

In addition, 6 designates an operation panel which provides several kinds of switches, display and the like as illustrated in FIG. 2, which will be described later. This operation panel 6 is used to carry out the data input/output operation with respect to the CPU 2 via a panel interface 6*a* and the bus 5.

7 designates wheel-type controls containing a pitch bend wheel (or wheel-type control for the pitch bending) and a modulation wheel (or wheel-type control for the modulation of musical tone). Herein, control-input information representing the control input of the wheel is supplied to the CPU 2 via a wheel-type control interface 7*a* and the bus 5. Hereinafter, control input of the pitch bend wheel will be referred to as a bend value PB.

Further, 4 designates a random-access memory (RAM) with a battery backup function which can freely carry out a read/write operation under control of the CPU 2. As the envelope information of the musical tone generated from the electronic musical instrument, there is provided preset voice data in the ROM 3. The present embodiment is designed such that the user can freely make desirable sounds. Therefore, the RAM 4 provides a custom area for storing tone color information made by the customer (hereinafter, simply referred to as "custom voice data"). Herein, the present voice data and custom voice data respectively contain several kinds of information as shown in FIG. 27.

In FIG. 27, "pitch bend information" is the data representing the pitch bend width with respect to the maximum control input applied to the pitch bend wheel, while "modulation information" represents the modulation value with respect to the maximum control input applied to the modulation wheel. In addition, "envelope information" is the data representing the envelope of the musical tone, while "de-tune information" is the data representing the value of de-tune effect (i.e., pitch-shift value from fundamental pitch) of the musical tone.

Furthermore, 8 designates an external interface (based on MIDI, i.e., Musical Instruments Digital Interface) which carries out an input/output operation on MIDI signals with respect to external devices under control of the CPU 2.

Next, 9 designates a sound source circuit which is designed to generate a musical tone signal when receiving data representing the tone pitch, envelope, tone color and the like from the CPU 2 via the bus 5. As similar to the sound source circuit of the known electronic musical instrument, this sound source circuit 9 provides plural tone-generation channels, each of which is assigned by every key-operation event, so that it can generate plural musical tones.

10 designates a sound system which receives and amplifies the audio signal from the sound source circuit 9, so that a speaker 11 coupled to it will generate the musical sounds.

Next, description will be given with respect to the panel design of the operation panel 6 by referring to FIG. 2.

① Displays 20, 21

In FIG. 2, 20 designates a seven-segment-type LED display indicating three digits, and 21 designates a liquid crystal display (i.e., LCD) indicating 2×24 characters. These displays 20, 21 are used to display several kinds of data for the user. FIG. 28 illustrates some display examples of the LCD 21. As illustrated in FIG. 28(*a*), the LCD 21 can display the inverse image.

② Orchestration Keys and LEDs

The present electronic musical instrument can simultaneously generate two series of musical tones (e.g., piano and violin sounds), hereinafter, for convenience' sake, these series will be referred to as "orchestra 1" and "orchestra 2" respectively. As the method (i.e., performance method) how to designate the performance with respect to two series of orchestras, the present embodiment provides three orchestration modes (simply referred to as "mode") as follows.

(i) Mode 1, which enables the performance concerning a single tone color. Herein, "orchestra 1" is used, but "orchestra 2" is not used.

(ii) Mode 2, which enables the performance concerning two kinds of tone colors. Herein, two tone colors can be sounded from any one of keys to be depressed. In other words, the pitch corresponding to both of orchestras 1, 2 is set with respect to each key.

(iii) Mode 3, which enables the performance concerning two kinds of tone colors. However, different from mode 2, this mode is set such that the whole key area of the keyboard 1 is divided into two parts each corresponding to each of orchestras 1, 2. Therefore, as for one key belonging to one of two areas, only one tone color corresponding to one orchestra is concerned. More specifically, the whole key area of the keyboard 1 is divided into right and left areas from the predetermined split point, so that sounds of orchestra 1 are generated from the depressed keys belonging to the right area, while sounds of orchestra 2 are generated from the depressed keys belonging to the left area, for example.

In order to select one of the above-mentioned three modes, there are provided three orchestration keys 33, 34, 35, one of which is to be depressed by the user. In addition, there are provided three LEDs 30, 31, 32 respectively corresponding to the orchestration keys 33, 34, 35, so that one of them is lighted on when selecting one of three modes.

③ Tone Color Selection Keys

In the present embodiment, it is possible to set one hundred kinds of tone color data with respect to each of the preset voice data and custom voice data. Herein, tone color numbers "00" through "99" are set for each of the tone color data, wherein 10s-order is called "bank portion" and 1s-order is called "number portion".

In FIG. 2, 50–59 designate bank selection keys, so that digits "0" to "9" are set to the bank portion of the tone color number by depressing them. Similarly, 60–69 designate number selection keys, so that digits "0" to "9" are set to the number portion by depressing them.

④ Voice Selection Keys and Voice Indication LEDs

As described before, the present embodiment is designed to generate the musical tone by using the combination of two orchestras. For instance, when determining the tone color for each orchestra, it is necessary to designate the orchestra to which the tone color is set in advance. For this reason, the present embodiment provides two keys 44, 45 and two LEDs 41, 42, wherein these keys are used to indicate the selection of orchestras 1, 2, while these LEDs are lighted on when the orchestras 1, 2 are selected respectively.

By use of the foregoing bank selection keys and number selection keys, it is possible to designate the desirable tone color number within "00" through "99". In this case, it is necessary to indicate the selection of the preset voice data and custom voice data with respect to the designated tone color number. Therefore, the present embodiment provides a key 43, by which one of the preset voice data and custom voice data is set for the selected orchestra (of which selection is indicated by the LEDs 41, 42 to be lighted on). Every time the key 43 is depressed, selection of the voice data is changed over. When the custom voice data is selected, a LED 40 is lighted on.

⑤ Function Selection Keys

The present embodiment provides several kinds of functions which enable the setting operation of the tone color and switching operation of the modes by the user. Herein, function selection keys 70 to 77 are provides, and a key 78 is further provided to end the function selection. Incidentally, specified operations of these functions will be described later.

⑥ "+", "−" Keys

Keys 22 to 25 are used to increment or decrement values of several kinds of information, wherein specified operations of these keys will be described later.

⑦ Demonstration Key

A key 79 is provided to start the performance demonstration, of which operation will be described later.

[B] Operation of Embodiment

Next, description will be given with respect to the operation of the present embodiment by referring to FIGS. 3 to 23. Incidentally, these drawings are flowcharts showing the control programs to be set in the ROM 3, wherein FIG. 3 is a flowchart showing a main process routine, so that other programs are set as the subroutines of this main process routine. Herein, program of the main process routine is read by the CPU 2 at first.

In the present specification, description will be given with respect to the whole operation of the present embodiment by referring to FIG. 3, and then, the specified operations will be described later by referring to the other flowcharts showing the subroutines.

First, when the power is on so that the main process routine as shown in FIG. 3 is started, the CPU 2 reads programs of an initialization routine (see FIG. 4) in step SP1 so that the predetermined initialization process is carried out. In next step SP2, the CPU 2 scans the operating state of the keyboard 1. Based on the scanning result, it is judged whether or not any key event (i.e., new key-depression or new key-release) is occurred in step SP3. When it is judged that the key event is occurred and consequently the judgement result of SP3 turns to "YES", the processing proceeds to step SP4 wherein a key-event process routine (see FIG. 5) is read out so as to carry out the necessary key-event processes. Then, the processing proceeds to step SP5. On the other hand, if the judgement result of step SP3 turns to "NO", the processing directly proceeds to step SP5.

In step SP5, the operating state of the operation panel 6 is scanned. Based on the scanning result, it is judged whether or not any panel event (i.e., new key input of the panel switch and the like) is occurred in step SP6. If the judgement result of step SP6 is "YES", the processing proceeds to step SP7 wherein a panel-event process routine (see FIG. 11) is read out so as to carry out the necessary panel-event processes. Then, the processing proceeds to step SP8. On the other hand, if the judgement result of step SP6 is "NO", the processing directly proceeds to step SP8.

In step SP8, the operating state of the wheel-type control 7 is scanned. Based on the scanning result, it is judged whether or not any wheel-type control event (i.e., control input of wheel-type control 7) is occurred in step SP9. If the judgement result of step SP9 is "YES", the processing proceeds to step SP10 wherein a wheel-type control process routine (see FIG. 26) is read out so as to carry out the necessary wheel-type control processes. Thereafter, the processing proceeds to step SP11. On the other hand, if the judgement result of step SP9 is "NO", the processing directly proceeds to step SP11.

In step SP11, other processes are to be carried out. Thereafter, the processing returns to the foregoing step SP2. Thus, processes of steps SP2 to SP11 are repeatedly carried out in the main process routine.

Next, detailed description will be given with respect to the process of each step in the main process routine by referring to the flowcharts of subroutines in turn.

(1) Initialization Process

Now, description will be given with respect to the initialization process by referring to FIG. 4.

When this process shown in FIG. 4 is started, the sound source circuit 9 and other peripheral circuits are initialized in step SP20. In next step SP21, it is judged whether or not a variable "IMSG" is equal to "1". Herein, this variable IMSG indicates whether or not the initial message is displayed. This initial message is displayed when IMSG is at "1", while it is not displayed when IMSG is at "0". Incidentally, the initial message is an on-screen image displaying the name of manufacturing company, program name or demonstration image to be displayed when the power is on.

When the judgement result of this step SP21 is "YES", the processing proceeds to step SP22 wherein the contents of the predetermined opening message data is displayed. Then, the processing proceeds to step SP23. On the other hand, if the judgement result of step SP21 is "NO", the processing directly proceeds to step SP23. Due to the provision of these steps SP21, SP22, the user can determine whether or not the initial message is displayed by setting the variable IMSG at "1" or "0" in advance.

In step SP23, it is judged whether or not another variable PBAK is at "0". Herein, this variable PBAK indicates whether or not the backup operation (i.e., data retaining operation to be made when the power supply is interrupted) is carried out on the parameters for controlling the musical tones which are stored in the RAM 4. This backup operation is made when PBAK is at "1", while it is not made when PBAK is at "0". When the variable PBAK is set at "1", the judgement result of step SP23 turns to "NO", so that the processing proceeds to step SP26. In this case, the backup operation is not required because the RAM 4 is originally designed as a memory device accompanied with the battery backup function.

In contrast, when the judgement result of step SP23 is "YES", the remaining processes, i.e., steps SP24 and SP25 are to be carried out so as to erase the data from the memories. In step SP24, several kinds of registers are initialized. In step SP25, the preset voice data stored in the ROM 3 is written into the custom area which is set in the storage area of the RAM 4. When completing these processes, the processing proceeds to step SP26.

In step SP26, the selected tone color (i.e., custom or preset voice data) is displayed on the screen of the LCD 21. Thereafter, the processing returns back to the foregoing main process routine.

(2) Key-Event Process

Next, description will be given with respect to the key-event process by referring to FIG. 5.

In FIG. 5, when this process is started, the processing proceeds to step SP30 wherein it is judged whether or not the key event is the key-on (i.e., key-depression) event. If so, the judgement result of step SP30 turns to "YES", so that the processing proceeds to step SP31. On the other hand, if the key-release event is occurred, the judgement result of step SP30 turns to "NO", so that the processing proceeds to step SP35 wherein the key-off process is made. When the processing proceeds to step SP31, the CPU 2 checks a variable OM. Based on the check result, one of processes of steps SP32, SP33, SP34 is selectively executed.

Herein, the variable OM is set as the value indicating the orchestration mode. In this case, mode 1 is selected when OM equals to "1", mode 2 is selected when OM equals to "2", and mode 3 is selected when OM equals to "3". Therefore, the processing proceeds to step SP32 when OM equals to "1", it proceeds to step SP33 when OM equals to "2", and it proceeds to step SP34 when OM equals to "3", thus the process corresponding to the orchestration mode is to be executed.

Next, detailed description will be given with respect to each of the processes of steps SP32 to SP35.

① Operation of Mode 1 at Key-Depression (step SP32)

When the processing proceeds to step SP32, the CPU 2 reads a KON1 process routine as shown in FIG. 6. When this process shown in FIG. 6 is started, the processing proceeds to step SP40 wherein the CPU 2 searches an idle channel in the sound source circuit 9. In next step SP41, it is judged whether or not the idle channel is found. If the idle channel is existed, the judgement result of step SP41 turns to "YES", so that the processing directly proceeds to step SP43. If not, the processing proceeds to step SP42 wherein the truncate process is made, thereafter, the processing proceeds to step SP43.

In the above-mentioned truncate process to be activated when there is no idle channel which can be assigned to the new key event, the process using another channel is forced to be canceled (or opened) and such opened channel is assigned to the new key event. In general, as the channel of which process is forced to be canceled, it is possible to choose the channel of which envelope is the smallest, i.e., of which tone-generation is close to the end. However, the channel of which pitch is the lowest have a relatively large contribution to the tone-generation of chord. Therefore, such highly contributing channel can be remained.

In step SP43, it is judged whether or not a flag VM[1] is equal to "1". Herein, this flag VM[1] indicates whether the orchestra 1 is in the preset mode or custom mode. In this case, the preset mode is designated when the flag is at "0", while the custom mode is designated when the flag is at "1". If the judgement result of step SP43 is "YES" indicating that the custom mode is designated, the processing proceeds to step SP44 wherein the CPU 2 reads the tone color data from the custom parameter area of the RAM 4 and then sets it to tone color area TC[1]. On the other hand, if the judgement result of step SP43 is "NO", the processing proceeds to step SP45 wherein the CPU 2 reads the tone color data from the preset parameter area and then sets it to tone color area TC[1].

Next, the processing proceeds to step SP46 wherein the idle channel be detected in step SP41 or another idle channel to be opened in step SP42 in the sound source circuit 9 is assigned to the current key event. Then, each data set in the tone color area TC[1] is outputted to the idle channel of the sound source circuit 9.

In next step SP47, on the basis of the keycode KC outputted from the keyboard 1, bend value PB and bend width PBW[1] of the wheel-type control 7, the CPU 2 computes the frequency (i.e., output frequency) of the musical tone to be generated, and the computed output frequency is supplied to the sound source circuit 9.

In step SP48, the touch information TI outputted from the keyboard 1 and the envelope information obtained from the parameters are outputted to the sound source circuit 9. Thus, on the basis of several data to be supplied in the above-mentioned processes of steps SP46 to SP48, the sound source circuit 9 generates and outputs a musical tone signal to the sound system 10. Thereafter, the processing returns to the foregoing key-event process routine (see FIG. 5). and then further returns back to the main process routine (see FIG. 3).

② Operation of Mode 2 at Key-Depression (step SP33)

When the processing proceeds to step SP33 shown in FIG. 5, KON2 process routine as shown in FIGS. 7, 8 is read out. When this process is started, a variable i is set at "1" in step SP50. Herein, the variable i indicates the number of orchestra on which the orchestration process is carried out. In this case, orchestra 1 is selected when i is set at "1", while orchestra 2 is selected when i is set at "2". In step SP50, this variable i is set at "1" so that the orchestration process is carried out on the orchestra 1. In next steps SP51 to SP53, as similar to the foregoing processes of steps SP40 to SP42 (see FIG. 6), the idle channel is searched, and if no idle channel is found, the foregoing truncate process will be made.

Then, the processing proceeds to step SP54 wherein it is judged whether or not the flag VM[i] (i.e., flag VM[1] at current stage) is at "1". If the judgement result of step SP54 is "YES" so that the orchestra 1 is in the custom mode, the processing proceeds to step SP55 wherein, as similar to the foregoing process of step SP44 (see FIG. 6), the tone color data is read from the custom parameter area of the RAM 4 and the read tone color data is set to the tone color area TC[i] (i.e., TC[1] at the current stage). On the other hand, if the judgement result of step SP54 is "NO", the processing proceeds to step SP56 wherein the tone color data is read from the preset parameter area and the read tone color data is set to the tone color area TC[i] (i.e., TC[1]).

In next step SP57, the idle channel to be detected in step SP52 or another idle channel to be opened in step SP53 in the sound source circuit 9 is assigned to the key event of the orchestra 1. Then, each data set to the tone color area TC[i] (i.e., TC[1]) is outputted to this idle channel in the sound source circuit 9.

After completing the process of step SP57, the processing proceeds to step SP58 shown in FIG. 8 wherein it is judged whether or not a variable ADJ is at "1". Herein, this variable ADJ indicates whether or not the pitch bend width set for the orchestra 1 must be coincided with the pitch bend width set for the orchestra 2. In other words, when this variable ADJ is set at "0", the pitch bend widths of the orchestras 1, 2 are respectively and independently determined based on the variables PBW[1], PBW[2]. On the other hand, when the variable ADJ is set at "1", both of the orchestras 1, 2 have the same pitch bend width which is determined based on the smaller one of PBW[1], PBW[2].

The above-mentioned setting method of the pitch bend width is embodied by processes of steps SP58 to SP62. First, if the judgement result of step SP58 is "NO" so that the variable ADJ is set at "0", the processing proceeds to step SP59 wherein the contents of the variable PBW[i] (i.e., PBW[1] at the current stage) is transferred as the variable PBW. This variable PBW is the value representing the pitch bend width of the orchestra on which the current process is made. Therefore, if the processing proceeds to step SP59, different pitch bend width is set in response to the contents of the variable i, i.e., orchestra to be processed.

In contrast, when the judgement result of step SP58 is "YES", the processing proceeds to step SP60 wherein it is judged whether or not the variable PBW[1] is larger than the variable PBW[2]. If the judgement result of step SP60 is "YES", the processing proceeds to step SP62 wherein the contents of the variable PBW[2] is set as the variable PBW. On the other hand, if the judgement result of step SP60 is "NO", the processing proceeds to step SP61 wherein the contents of the variable PBW[1] is set as the variable PBW. Therefore, the same pitch bend width is commonly set, regardless of the contents of the variable i, i.e., orchestra to be processed.

In step SP63, as similar to the foregoing process of step SP47 (see FIG. 6), on the basis of the keycode KC outputted from the keyboard 1, bend value PB and bend width PBW of the wheel-type control 7, the CPU 2 computes the frequency (i.e., output frequency) of the musical tone to be generated from the orchestra i (i.e., orchestra 1 at the current stage), and then the computed output frequency is supplied to the sound source circuit 9.

In next step SP64, as similar to step SP48, the touch information TI outputted from the keyboard 1 and the envelope information obtained from the parameters are outputted to the sound source circuit 9. Thus, the sound source circuit 9 generates the musical tone of the orchestra 1 on the basis of several data which are supplied thereto in steps SP57 to SP64.

In step SP65, "1" is added to the variable i so that the variable i becomes equal to "2". In next step SP66, it is judged whether or not the variable i is larger than "2". At the current stage, the judgement result of step SP66 is "NO", so that the processing returns to step SP51 shown in FIG. 7. Then, the foregoing processes of steps SP52 to SP64 are carried out on the orchestra 2, so that several data concerning the orchestra 2 are supplied to the sound source circuit 9. Thus, the sound source circuit 9 generates the musical tone signals based on the orchestras 1, 2, and the corresponding musical tones are sounded from the sound system 10.

Thereafter, when the processing proceeds to step SP65 again, the variable i is incremented to "3", so that the judgement result of step SP66 turns to "YES". Then, the processing returns to the key-event process routine (see FIG. 5), and it further returns back to the main process routine (see FIG. 3).

③ Operation of Mode 3 at Key-Depression (step SP34)

When the processing proceeds to step SP34 in FIG. 5, the CPU 2 reads out a KON3 process routine as shown in FIG. 9. When this process is started, the processing proceeds to step SP70 wherein it is judged whether or not the keycode KC is larger than a split point SP. Herein, this split point SP indicates the keycode corresponding to the key having the maximum pitch within the keys assigned to the orchestra 2. Therefore, in the case where the judgement result of this step SP70 is "YES", the depressed key must belong to the orchestra 1. In such case, the processing directly proceeds to step SP80 wherein the KON1 process routine (see FIG. 6) is read out. Thus, the processes as similar to those of mode 1 are carried out on the orchestra 1, so that the musical tones of the orchestra 1 will be sounded under operation of the sound source circuit 9 and sound system 10.

On the other hand, if the judgement result of step SP70 is "NO", processes of steps SP71 to SP79 are executed. These processes of steps SP71 to SP79 which are made with respect to the orchestra 2 are identical to those of the foregoing steps SP40 to SP48. Therefore, the processes as similar to those of mode 1 are carried out on the orchestra 2, so that the musical tones of the orchestra 2 will be sounded under operation of the sound source circuit 9 and sound system 10.

As described above, in the mode 3, one of the orchestras 1, 2 is selected on the basis of the keycode KC of the depressed key, so that the same operation of the mode 1 is performed on the selected orchestra. Thereafter, the processing returns to the key-event process routine (see FIG. 5) and then it returns back the main process routine (see FIG. 3).

④ Operation at Key-Release

When the processing proceeds to step SP35 in FIG. 5, the CPU 2 reads out a KOFF process routine as shown in FIG. 10. When this process is started, the processing proceeds to step SP81 wherein it is judged whether or not the CPU 2 can find out the channel by which the musical tone having the keycode KC corresponding to the key-release event is generated in the sound source circuit 9. If the judgement result of this step SP81 is "NO", this routine is ended. In this case where the judgement result of step SP81 immediately turns to "NO", the channel corresponding to the key-release event may have been already opened by the foregoing truncate process (see steps SP42 etc.).

On the other hand, when the judgement result of step SP81 is "YES", the processing proceeds to step SP82 wherein tone-generation ending information for the channel corresponding to the key-release event is outputted to the sound source circuit 9. Thus, the tone-generation of this channel is ended, and consequently this channel is opened. Next, the processing returns to step SP81, therefore, it is judged again whether or not there is existed the channel in which the tone-generation is made by the same keycode KC. Then, the above-mentioned process is repeated. The reason why the above-mentioned key-release operation is repeatedly performed is that there exists two channels which have different tone colors but same keycode KC.

(3) Panel-Event Process

Next, description will be given with respect to a panel-event process by referring to FIG. 11.

When this process is started, processes of steps SP90 to SP95 discriminate the kind of the key on which the panel event is occurred. On the basis of the discriminated kind of key, one of processes of steps SP96 to SP102 is selectively executed. Herein, the processing proceeds to step SP96 via step SP90 if the key on which the panel event is occurred concerns the tone color selecting operation (i.e., "VOICE SEL." keys); the processing proceeds to step SP97 via steps SP90, 91 if it concerns the function selecting operation (i.e., "FUNC. SEL." keys); the processing proceeds to step SP98 via steps SP90 through SP92 if it concerns the voice (i.e., "VOICE" keys); the processing proceeds to step SP99 via steps SP90 through SP93 if it concerns the orchestration (i.e., "ORCHESTRATION" keys); the processing proceeds to step SP100 via steps SP90 through SP94 if it is a "+" or "−" key; the processing proceeds to step SP101 via steps SP90 through SP95 if it is a "DEMO" key; and the processing proceeds to step SP102 via steps SP90 through SP95 if it concerns other operations.

Next, detailed description will be given with respect to each of the processes of steps SP96 to SP102 specifically.

① Process of Tone Color Select (VOICE SEL.) keys

In FIG. 11, when the processing proceeds to step SP96, the CPU 2 reads out a VOICE SEL. key process routine (see FIG. 12). When this process shown in FIG. 12 is started, the processing proceeds to step SP103 wherein it is judged whether or not the key on which the key event is occurred (hereinafter, simply referred to as "key-event key") is a number selection key. If the judgement result of this step SP103 is "NO" (which indicates that the key-event key is a bank selection key), the processing proceeds to step SP104 wherein the LCD 21 clears its display portion of the voice selection information corresponding to a variable VS. Herein, this variable VS indicates the selected orchestra. In this case, the orchestra 1 is selected when this variable VS is at "1", while the orchestra 2 is selected when it is at "2".

For example, the orchestra 1 is selected and the LCD 21 displays as follows:

"VOICE ORCH. 1 > 00:PIANOI
ORCH. 2 > 15:STRINGS"

In this case, the CPU 2 executes the process of step SP104, so that the displayed image is changed as follows:

"VOICE ORCH. 1 >
ORCH. 2 > 15:STRINGS"

In next step SP105, the LCD 21 displays the bank number which is selected by the bank selection key. For example, when the key 65 indicating the bank number "5" (see FIG. 2) is depressed, the LCD 21 displays as follows:

"VOICE ORCH. 1 > 5
ORCH. 2 > 15:STRINGS"

In next step SP106, the CPU 2 multiplies the bank number by "10", and its multiplication result is set. Herein, the variable TC indicates one of one-hundred kinds of tone colors, i.e., one of tone color numbers "00" to "99". In the present example, the variable TC is set at "50".

In step SP107, the CPU 2 scans the operation panel 6. In step SP108, it is judged whether or not the bank selection key is depressed. If the judgement result of this steps SP108 is "NO", the processing proceeds to step SP109 wherein it is judged whether or not the number selection key is depressed. If the judgement result of step SP109 is "NO", the processing returns to step SP107. Therefore, these processes of steps SP107 to SP109 are repeated until the bank selection key or number selection key is depressed.

When the bank selection key is depressed, the judgement result of step SP108 turns to "YES", so that the processing returns to step SP105. Then, based on the newly depressed bank selection key, the processes of steps SP105, SP106 are executed, so that the displayed bank number and variable TC are changed.

On the other hand, when the number selection key is depressed, the processing proceeds to step SP110 via steps SP107 to SP109.

In step SP110, the CPU 2 performs the calculation based on the following formula (1):

$$TC \leftarrow TC - TCmod10 + (NUMBER) \quad (1)$$

In the above formula (1), "TCmod10" designates a remainder which is obtained when the variable TC is divided by "10". For example, when the variable TC is set at "53", "TCmod10" is "3". In addition, (NUMBER) is a value which corresponds to the depressed number selection key. As described before, this value is set equal to one of "0" to "9".

In the case where before executing the process of step SP110, the variable TC is set at "53" and the number selection key 64 (corresponding to value "4") is depressed, the process of step SP110 results that the variable TC is changed to "54". As described above, due to the process of step SP110, the bank-portion value of the tone color number is not changed, while the number-portion value is only changed in response to the depressed number selection key.

In next step SP111, value of the variable TC is transferred to a variable TC[VS]. As described before, the variable TC designates the selected orchestra, so that the value thereof is set at "1" or "2". Consequently, the variable TC[VS], i.e., TC[1] or TC[2], designates the tone color number in the orchestra 1 or 2.

In next step SP112, the CPU 2 executes a tone color image change-over process (of which details will be described later), so that the LCD 21 displays the contents of the data which are changed by the foregoing processes of steps SP103 to SP111. After completing the above-mentioned processes, the processing returns to the panel-event process routine (see FIG. 11) and it also returns back to the main routine (see FIG. 3).

The above-mentioned series of processes are executed under the condition where the judgement result of step SP103 is "NO". Next, description will be given with respect to the case where the number selection key is depressed at first so that the judgement result of step SP103 is "YES".

In this case, from step SP103, the processing proceeds to step SP113 wherein the contents of the variable TC[VS] (i.e., tone color number or the orchestra 1 or 2) is transferred to the variable TC.

Then, by executing the process of step SP110, the number-portion value of the variable TC is changed in response to the depressed number selection key. Such changed variable TC is transferred to the variable TC[VS], so that the tone color number of the orchestra to be designated by the variable VS is changed. Thereafter, under execution of the tone color image change-over process of step SP112, the LCD 21 displays the changed contents of data. Then, the processing returns back to the main routine (see FIG. 3) via the panel-event process routine (see FIG. 11).

② Tone Color Image Change-Over Process

Next, description will be given with respect to the contents of the tone color image change-over process routine, to be read out when the processing reaches step SP112, by referring to FIGS. 17, 18.

When this process is started, the processing proceeds to step SP160 (see FIG. 17) wherein the LCD 21 displays a message MSG[2] on the upper display-portion of its screen. In short, the LCD 21 displays as follows:

"VOICE
"

In next step SP161, it is judged whether or not the selected orchestra is the orchestra 1 by referring to the variable VS. If the judgement result of this step SP161 is "YES", the processing proceeds to step SP162 wherein the LCD 21 displays a message MSG[3] in inverse manner on the upper-middle display-portion of its screen. Hereinafter, for convenience's sake, the inverse image is represented by the underlined part in the present specification. In next step SP163, the LCD 21 further displays a message MSG[4] on the lower-middle display-portion of its screen. Therefore, by executing the processes of steps SP162, SP163, the LCD 21 displays as follows:

"VOICE <u>ORCH. 1</u>
<u>ORCH. 2</u> "

On the other hand, when the judgement result of step SP161 is "NO", the processing branches to step SP164 wherein the LCD 21 displays the message MSG[3] on the upper-middle display-portion of its screen. In next step SP165, the LCD 21 further displays the message MSG[4] on the lower-middle display-portion of its screen in inverse manner. Therefore, by executing the processes of steps SP164, 165, the LCD 21 displays as follows:

"VOICE ORCH. 1
<u>ORCH. 2</u> "

In the above-mentioned processes of steps SP161 to SP165, characters designating the selected orchestra (i.e., "ORCH. 1" or "ORCH. 2") are displayed in inverse manner.

Then, the processing proceeds to step SP166 wherein the LCD 21 displays the contents of variable TC[1] designating the tone color of orchestra 1, characters ":" and TN[TC[1]] on the upper-right display-portion of its screen. In next step SP167, the LCD 21 further displays the character ">" at the predetermined display-portion which is close to the leftside of "TC[1]". Herein, TN[TC[n]] (where n is set at "1" or "2") is the characters which can be arbitrarily defined by the user with respect to the tone color numbers "00" to "99". For example, "PIANO" can be defined for the tone color number "00", or "STRINGS" can be defined for the tone color number "15".

In next step SP168, it is judged whether or not the flag VM[1] is at "1". If the judgement result is "YES", the processing proceeds to step SP169. As described before, the flag VM[n] (where n denotes "1" or "2") is used to indicate that the orchestra n is in the preset mode or custom mode. The preset mode is designated when it is at "0", while the custom mode is designated when it is at "1".

In step SP169, the character ":" which is previously displayed is inverted. Thus, the user can identify whether the displayed orchestra is in the custom mode or preset mode by watching whether or not the character ":" is displayed in inverse manner.

Then, the processing proceeds to step SP170 wherein the LCD 21 displays the contents of variable TC[2], characters ":" and TN[TC[2]] on the lower-right display-portion of its screen. In next step SP171, it is judged whether or not the variable OM indicating the orchestration mode is at "1". If the judgement result of this step SP171 is "NO", the processing proceeds to step SP172 wherein the LCD 21 further displays the character ">" in the predetermined display-portion which is close to the leftside of TC[2]. Thereafter, the processing proceeds to step SP173. On the other hand, if the judgement result of step SP171 is "YES" indicating that the orchestration mode is at "1", the processing directly proceeds to step SP173. In this case, the character ">" designates the orchestra to be used, and the orchestra 2 is not used when the orchestration mode is at "1".

In step SP173, it is judged whether or not the flag VM[2] is at "1". If the judgement result is "YES", the processing proceeds to step SP174 wherein the character ":", which is displayed in the foregoing step SP170, is inverted.

By executing the above-mentioned processes of steps SP160 to SP174, the LCD 21 displays as follows:

"VOICE ORCH. 1 > 00 : PIANOI

ORCH. 2 > 15 : STRINGS"

Then, the processing proceeds to step SP175 (see FIG. 18) wherein all of the LEDs provided on the operation panel 6 are turned off.

In next steps SP176 to SP179, light-on states of the LEDs 30 to 32 are controlled on the basis of the orchestration mode. More specifically, when the orchestration mode is at "1", the processing proceeds to step SP177 wherein the LED 30 is turned off. When the orchestration mode is at "2", the processing proceeds to step SP178 wherein the LED 31 is turned off. When the orchestration mode is at "3", the processing proceeds to step SP179 wherein the LED 32 is turned off.

In next step SP180, it is judged whether or not the variable VS indicating the selected orchestra is at "1". If the judgement result is "YES", the processing proceeds to step SP181 wherein the LED 41 is lighted on. If not, the processing proceeds to step SP182 wherein the LED 42 is lighted on.

Then, the processing proceeds to step SP183 wherein it is judged whether or not the flag VM[VS] is at "1", in other words, it is judged whether or not the tone color of the selected orchestra is set as the custom voice. In case of the custom voice, the judgement result is "YES", and consequently the processing proceeds to step SP184 wherein the LED 40 is lighted on. After completing the above-mentioned processes of steps SP183, SP184, the processing returns back to its source program.

③ Function Selection (FUNCTION SEL.) Key Process

Next, detailed description will be given with respect to a FUNCTION SEL. key process routine, which is accessed when executing the process of step SP97 shown in FIG. 11, by referring to FIG. 13.

When this process shown in FIG. 13 is started, the processing proceeds to step SP120 wherein the LED display 20 indicates the number of the depressed function selection key. In next step SP121, the CPU 2 executes the process corresponding to the depressed function selection key. There are provided eight function selection keys, to each of which the specific function can be assigned arbitrarily. As examples of such functions, the present embodiment provides functions 1 to 4, which will be described below.

(i) Function 1

When the depressed function selection key is the key 71 (corresponding to "FUNCTION 1"), the CPU 2 reads out a function-1 process routine as shown in FIG. 19. This routine is provided such that the user can set the split point in the orchestration mode 3.

When this process is started, the processing proceeds to step SP190 wherein the LCD 21 displays a message of "SPLIT POINT" on the upper screen-portion thereof. In next step SP191, the LCD 21 displays "Split=" on the lower screen-portion thereof. In step SP192, the LCD 21 continuously displays the symbol of the key corresponding to the split point SP on the lower screen-portion thereof. As a result, the LCD 21 displays as follows:

"SPLIT POINT
Split= F#2/G2"

Then, the processing proceeds to step SP206 wherein it is judged whether or not the key event is occurred. If the judgement result is "YES", the keycode of the depressed key is set to the new split point SP. In next step SP195, the CPU 2 scans the operation panel 6. In step SP196, it is judgement result of this step SP196 is "YES", the processing proceeds to step SP197. In the following steps SP197 to SP199, responsive to the depressed key, the processing branches to its corresponding routine.

First, when the key 23 (i.e., P1 key) is depressed, the processing proceeds to step SP203 via step SP197, wherein the split point SP is incremented by "1". In other words, the keycode of which split point is higher than the original by "1" is set as the new split point. In next step SP204, it is judged whether or not the split point SP is larger than "97". If the judgement result is "YES", the processing proceeds to step SP205 wherein the split point SP is set at "97". This prohibits the split point SP from being larger than or equal to "98".

On the other hand, when the key 22 (i.e., M1 key) is depressed, the processing passes through step SP197, SP198 and then reaches step SP200 wherein the split point SP is decremented by "1". In short, the keycode of which split point is lower than the original by "1" is set as the new split point. In next step SP201, it is judged whether or not the split point SP is lower than "24". If the judgement result is "YES", the processing proceeds to step SP202 wherein the split point SP is set at "24". This prohibits the split point SP from being lower than or equal to "23".

When the key 78 (i.e., EXIT key) is depressed, the processing returns to the foregoing panel-event process routine (see FIG. 11) via steps SP197 to SP199, and then it returns back to the main routine (see FIG. 3).

When the other keys are depressed, or when completing the processes of steps SP200 to SP205, the processing returns to step SP192. Thus, until the key 78 (i.e., EXIT key) is depressed, the above-mentioned processes are repeated.

(ii) Function 2

In the case where the depressed function selection key is the key 72 (corresponding to "FUNCTION 2"), the CPU 2 reads out a function-2 process routine as shown in FIG. 20. Due to the provision of this routine, the user can freely set the variable ADJ, by which the pitch-bend-width of the orchestra 1 can be coincided with that of the orchestra 2.

When this process shown in FIG. 20 is started, the processing proceeds to step SP210 wherein the LCD 21 displays a message of "PITCH BEND SELECT" on the upper screen-portion thereof. In next step SP211, the LCD 21 displays "Adjust=" on the lower screen-portion thereof.

In step SP212, it is judged whether or not the variable ADJ is equal to "1", indicating that whether or not the pitch-bend-width of the orchestra 1 is determined independently, regardless of that of the orchestra 2. If the judgement result is "YES", the processing proceeds to step SP213 wherein the LCD 21 displays "ON" on the lower-middle screen-portion thereof. If not, the processing branches to step SP214 wherein the LCD 21 displays "OFF". As a result, the LCD 21 displays as follows:

"PITCH BEND SELECT
Adjust=ON "

Then, the processing proceeds to step SP215 wherein the CPU 2 scans the operation panel 6. In next step SP216, it is judged whether or not the panel event is occurred. If the judgement result is "YES", the processing proceeds to step SP217. In processes of steps SP217 to SP219, the CPU 2 branches its processing to the routine corresponding to the depressed key.

First, when the key 23 (i.e., P1 key) is depressed, the processing proceeds to step SP221 via step SP217, wherein the variable ADJ is set at "1". On the other hand, when the key 22 (i.e., M1 key) is depressed, the processing proceeds to step SP220 via steps SP217, SP218, wherein the variable ADJ is set at "0". When the key 78 (i.e., EXIT key) is depressed, the processing passes through steps SP217 to SP219, so that it returns to the penal-event process routine (see FIG. 11), and then it also returns back to the main routine (see FIG. 3).

In the case where the other keys are depressed, or when completing the processes of steps SP220, SP221, the processing returns to step SP212, so that until the key 78 (EXIT key) is depressed, the above-mentioned processes are repeated.

(iii) Function 3

If the depressed function selection key is the key 73 (concerning "FUNCTION 3"), the CPU 2 reads out a function-3 process routine as shown in FIG. 21. Due to the provision of this routine, the user can freely set the variable PBAK, by which the memory backup operation can be selectively made.

When this process shown in FIG. 21 is started, the processing proceeds to step SP230 wherein the LCD 21 displays a message of "MEMORY BACK UP" on the upper screen-portion thereof. In next step SP231, the LCD 21 displays "Backup=" on the lower screen-portion thereof.

In step SP232, it is judged whether or not the variable PBAK is equal to "1", indicating that whether or not the backup operation is in the on-state. If the judgement result is "YES", the processing proceeds to step SP233 wherein the LCD 21 displays "ON" on the lower-middle screen-portion thereof. If not, the processing branches to step SP234 wherein the LCD 21 displays "OFF". As a result, the LCD 21 displays as follows:

"MEMORY BACK UP
Backup=ON "

Then, the processing proceeds to step SP235 wherein the CPU 2 scans the operation panel 6. In next step SP236, it is judged whether or not the panel event is occurred. If the judgement result is "YES", the processing proceeds to step SP237. In processes of steps SP237 to SP239, the CPU 2 branches its processing to the routine corresponding to the depressed key.

First, when the key 23 (P1 key) is depressed, the processing proceeds to step SP241 via step SP237, wherein the variable PBAK is set at "1". When the key 22 (M1 key) is depressed, the processing passes through steps SP237, SP238 and then reaches step SP240, wherein the variable PBAK is set at "0". Further, when the key 78 (EXIT key) is depressed, the processing passes through steps SP237 to SP239, so that it returns to the panel-event process routine (see FIG. 11) and then it also returns back to the main routine (see FIG. 3).

When the other keys are depressed, or when completing the processes of steps SP240, SP241, the processing returns to step SP232, so that until the key 78 (EXIT key) is depressed, the above-mentioned processes are repeated.

(iv) Function 4

When the depressed function selection key is the key 74 (concerning "FUNCTION 4"), the CPU 2 reads out a function-4 process routine as shown in FIG. 22. Due to the provision of this routine, the user can freely set the variable IMSG, by which it is determined whether or not the initial message is displayed.

When this process shown in FIG. 22 is started, the processing proceeds to step SP250 wherein the LCD 21 displays a message of "INITIAL MESSAGE" on the upper screen-portion thereof. In next step SP251, the LCD 21 displays "Message=" on the lower screen-portion thereof.

In step SP252, it is judged whether or not the variable IMSG is equal to "1", indicating that whether or not the LCD 21 is in the state where the initial message can be displayed. If the judgement result is "YES", the processing proceeds to step SP253 wherein the LCD 21 displays "ON" on the lower-middle screen-portion thereof. If not, the processing branches to step SP254 wherein the LCD 21 displays "OFF". As a result, the LCD 21 displays as follows:

"INITIAL MESSAGE
Message=ON "

Then, the processing proceeds to step SP255 wherein the CPU 2 scans the operation panel 6. In next step SP256, it is judged whether or not the panel event is occurred. If the judgement result is "YES", the processing proceeds to step SP257. In processes of steps SP257 to SP259, the CPU 2 branches its processing to the routine corresponding to the depressed key.

When the key 23 (P1 key) is depressed, the processing proceeds to step SP261 via step SP257, wherein the variable IMSG is set at "1". When the key 22 (M1 key) is depressed, the processing passes through steps SP257, SP258, and then it reaches step SP260 wherein the variable IMSG is set at "0". Further, when the key 78 (EXIT key) is depressed, the processing passes through steps SP257 to SP259, so that it returns to the panel-event process routine (see FIG. 11), and then it also returns back to the main routine (see FIG. 3).

When the other keys are depressed, or when completing the processes of step SP260, SP261, the processing returns to step SP252, so that until the key 78 (EXIT key) is depressed, the above-mentioned processes are repeated.

④ Voice Key Process

Next, description will be given with respect to the Voice key process which is read out when executing the process of step SP98 shown in FIG. 11, by referring to FIG. 14.

When this process shown in FIG. 14 is started, the processing proceeds to steps SP130, SP131 wherein the CPU 2 discriminates the depressed key from the keys 43 to 45. When the key 44 (i.e., ORCH.1 key) is depressed, the processing proceeds to step SP134 wherein the variable VS is set at "1". Thus, the CPU 2 sets the orchestra 1 as the orchestra to which the foregoing tone color image change-over process (see FIGS. 17, 18) and the like are to be made.

On the other hand, if the key 45 (i.e., ORCH.2 key) is depressed, the processing proceeds to step SP133 wherein the variable VS is set at "2". Thus, the CPU 2 sets the orchestra 2 as the orchestra to which the foregoing processes are to be made.

In contrast, if the depressed key is neither the keys 44 and 45, it must be judged inevitably that the depressed key is the key 43. In this case, the processing proceeds to step SP132 wherein logical state of the flag VM[VS] is inverted. In short, the CPU 2 changes over the mode (i.e., preset mode or custom mode) of the orchestra to which the foregoing processes are to be made.

When completing the above-mentioned processes of steps SP130 to SP134, the processing proceeds to step SP135, so that the tone color image change-over process subroutine (see FIGS. 17, 18) is read out. By the processes of steps SP180 to SP184, the CPU 2 changes the light-on states of the LEDs 40 to 42 respectively. After completing these processes, the processing returns to the panel-event process routine (see FIG. 11), and then it also returns back to the main routine (see FIG. 3).

(5) Orchestration Key Process

Next, description will be given specifically with respect to the orchestration key process routine which is read out when executing the process of step SP99 (see FIG. 11), by referring to FIG. 15. When this process shown in FIG. 15 is started, the processing proceeds to steps SP140, SP141 wherein the CPU 2 discriminates the depressed key from the keys 33 to 35. If the key 33 is depressed, the processing branches to step SP144 wherein the variable OM is set at "1". In other words, the orchestration mode is set at mode 1, so that the orchestra 1 will generate the musical tones having a single tone color.

On the other hand, if the key 34 is depressed, the processing proceeds to step SP143 wherein the variable OM is set at "2". In other words, the orchestration mode is set at mode 2, so that the orchestra 2 will generate the musical tones having two kinds of tone colors.

In contrast, if the depressed key is neither the keys 33 and 34, it must be judged inevitably that the depressed key is the key 35. In this case, the processing proceeds to step SP142 wherein the variable OM is set at "3". In other words, the orchestration mode is set at mode 3, so that the musical tones will be generated by use of the tone color corresponding to the orchestra 1 or 2 in response to the depressed key.

After completing the above-mentioned processes of steps SP140 to SP144, the processing proceeds to step SP145 wherein the CPU 2 reads out the tone color image change-over process subroutine (see FIGS. 17, 18). By the processes of steps SP175 to SP179, the CPU 2 changes over the light-on states of the LEDs 30 to 32. After completing these processes, the processing returns to the panel-event process routine (see FIG. 11), and then it also returns back to the main routine (see FIG. 3).

(6) "+", "−" Key Process

Next, description will be given specifically with respect to the "+", "−" key process routine which is read out when executing the process of step SP100 (see FIG. 11), by referring to FIG. 16.

When this process shown in FIG. 16 is started, the processing proceeds to step SP150 wherein it is judged whether or not the depressed key is the key 23 (i.e., P1 key). If the judgement result is "YES", the processing branches to step SP155 wherein the variable TC[VS] is incremented by "1". In other words, the tone color number of the orchestra to which the processes are to be made is increased by "1".

In next step SP156, it is judged whether or not the incremented variable TC[VS] is larger than "99". If the judgement result is "YES", the processing proceeds to step SP157 wherein the variable TC[VS] is cleared to "0". When completing these processes of steps SP155 to SP157, the processing returns to the main routine via the panel-event process routine.

On the other hand, if the judgement result of step SP150 is "NO", the processing proceeds to step SP151 wherein it is judged whether or not the key 22 (i.e., M1 key) is depressed. If the judgement result is "YES", the processing proceeds to step SP152 wherein the variable TC[VS] is decremented by "1". In other words, the tone color number of the orchestra to which the processes are to be made is decreased by "1". In next step SP153, it is judged whether or not the decremented variable TC[VS] is lower than "0". If the judgement result is "YES", the processing proceeds to step SP154 wherein the variable TC[VS] is newly set at "99".

After completing the above-mentioned processes of steps SP152 to SP154, the processing returns back to the main routine via the penal-event process routine.

Incidentally, if the depressed key is neither the keys 22 and 23, the processing passes through steps SP150, SP151, and then it returns back to the main routine via the panel-event process routine.

In the above-mentioned "+", "−" key process routine, by depressing the key 22 or 23, the user can freely increment or decrement the tone color number of the orchestra in a range from "0" to "99", so that the desirable tone color number can be designated.

(7) DEMO Key Process

Next, detailed description will be given with respect to the DEMO process routine which is read out when executing the process of step SP101 (see FIG. 11), by referring to FIGS. 23, 24.

When this process shown in FIGS. 23, 24 is started, the processing proceeds to step SP270 wherein the LCD 21 displays a message of "DEMONSTRATION" on the upper screen-portion thereof. In next step SP271, it is judged whether or not a DEMO disk is inserted into a disk drive 12 (see FIG. 1). If the judgement result is "NO", the processing branches to step SP274 wherein a variable SN is set at "1". Herein, the variable SN indicates the number of DEMO tunes which can be selected by the user. As described before, the ROM 3 memorizes only one DEMO tune, therefore, the variable SN is set at "1".

On the other hand, if the judgment result of step SP271 is "YES", the processing proceeds to step SP272 wherein the CPU 2 searches the disk for DEMO tunes, so that the CPU 2 will detects the number of DEMO tunes memorized in this disk. In next step SP273, the value which is calculated by incrementing the number of DEMO tunes by "1" is set as the variable SN. Because, the present system is designed such that both of the DEMO tunes memorized in the disk and ROM 3 can be performed.

When completing the processes of steps SP270 to SP274, the processing proceeds to step SP275 wherein a variable CSN is set at "1". Herein, the variable CSN indicates the song number of the selected DEMO tune. By the way, the DEMO tune memorized in the ROM 3 has a song number "1". For this reason, song number "2" etc. are sequentially assigned to the DEMO tunes in the disk.

Then, the processing proceeds to step SP276 wherein it is judged whether or not the variable CSN is larger than "1". In the initial state, this variable CSN is set at "1". Therefore, the judgement result must be "NO", and consequently the processing proceeds to step SP278 wherein the CPU 2 selects the built-in DEMO tune memorized in the ROM 3. On the other hand, if the variable CSN is changed to the value other than "1" (, which will be described later in detail), the judgement result of step SP276 turns to "YES". In this case, the processing proceeds to step SP277 wherein No. "CSN-1" tune in the disk is selected as the DEMO tune.

In step SP279, the LCD 21 displays the contents of the song number of the selected DEMO tune (represented by the variable CSN), tune name and number of tunes (represented by the variable SN), which are selected in the foregoing processes of steps SP277, SP278, on the lower screen-portion thereof. As a result, the LCD 21 displays as follows:

"DEMONSTRATION
1 BACH: TOCCATA & FUGA 50"

In step SP280, the CPU 2 scans the operation panel 6. Then, the processing proceeds to step SP290 (see FIG. 24), wherein it is judged whether or not the DEMO key is released. If the judgement result is "YES", the processing branches to step SP293 wherein the present electronic musical instrument automatically performs the DEMO tune which is selected by the foregoing process of step SP277 or SP278. In next step SP294, the tone color image change-over process (see FIGS. 17, 18) is carried out. Thereafter, the processing returns back to the main routine via the panel-event process routine.

On the other hand, if the judgement result of step SP290 is "NO", processes of steps SP291 to SP300 will be carried out. In these processes of steps SP291 to SP300, the song number of the DEMO tune which is selected when the key 24 (M2 key) or 25 (P2 key) is depressed is incremented or decremented. Therefore, by depressing the key 24 or 25 with depressing the key 79 (DEMO key) simultaneously, it is possible to change the song number according to the needs of the user.

Hereinafter, detailed description will be given with respect to the processes of steps SP291 to SP300.

In first step SP291, it is judged whether or not the key 24 (M2 key) is depressed. If the judgement result is "YES", the processing branches to step SP298 wherein the variable CSN is decremented by "1". In next step SP299, it is judged whether or not the decremented variable CSN is smaller than "1" (, in other words, it is judged whether or not CSN is equal to "0"). If the judgement result is "YES", the contents of the variable SN (representing the number of DEMO tunes) is written into the variable CSN.

For instance, in the case where the above-mentioned processes of steps SP298 to SP300 are repeated under the condition where the number of DEMO tunes is equal to "50", the song number of the DEMO tune to be selected is varied as "50", "49", . . . , "2", "1", "50", "49", . . . .

Meanwhile, if the step SP291 judges that the key 24 is not depressed, the processing proceeds to step SP292 wherein it is judged whether or not the key 25 (P2 key) is depressed. If the judgement result is "YES", the processing branches to step SP295 wherein the variable CSN is incremented by "1".

In next step SP296, it is judged whether or not the incremented variable CSN is larger than the variable SN. In other words, it is judged whether or not CSN becomes larger than the number of DEMO tunes which can be selected by the user. If the judgement result is "YES", the variable CSN is set at "1". Therefore, due to the provision of steps SP295 to SP297, the song number of the DEMO tune to be selected is varied in a reversed manner of the foregoing steps SP298 to SP300.

After completing the above-mentioned processes of steps SP291 to SP300, the processing returns to step SP276 (see FIG. 23), so that until the key 79 (DEMO key) is released, the processes of steps SP276 to SP300 are repeated.

⑧ Other Key Processes

The above description concerns the processes which are carried out when several kinds of keys are operated in conjunction with FIG. 11. If the other keys are operated, the processing passes through steps SP90 to SP95 and then it reaches step SP102 (see FIG. 11), wherein the processes corresponding to each of keys are to be made.

(4) Wheel-Type Control Process Routine

Next, description will be given with respect to a wheel-type control process by referring to FIG. 25.

When this process shown in FIG. 25 is started, the processing proceeds to step SP310 wherein it is judged whether or not the wheel-type-control event is the event of the pitch-bend wheel. If the judgement result is "YES", the processing proceeds to step SP311 wherein the control-input value of the pitch-bend wheel is transferred to the variable PB. Then, the processing proceeds to step SP312. On the other hand, if the judgement result of step SP310 is "NO", the processing directly proceeds to step SP312.

In step SP312, it is judged whether or not the wheel-type-control event is the event of the modulation wheel. If the judgement result is "YES", the control-input value of the modulation wheel is transferred to the variable MH in step SP313.

In next step SP314, events of the other controls are detected, and on the basis of the detection result, necessary processes are to be made. Thereafter, the processing returns back to the main routine.

[C] Modifications

The present invention is not limited to the above-mentioned embodiment. For example, the present embodiment can be modified as follows:

① In the embodiment, smaller pitch-bend-variation width is used. However, it is possible to use larger pitch-bend-variation width when determining the pitch-bend-variation.

(2) The embodiment uses two series of musical tones. However, it is possible to use multiple series of musical tones to be generated from the electronic musical instrument. In this case, the pitch-bend-variation width can be set at the intermediate value among those of multiple series of musical tones.

(3) The embodiment uses the pitch-bend parameter as an example of the musical tone parameter to be varied. However, it may be easily understood that the present invention can be applied to the other parameter control techniques concerning the LFO frequency control, cut-off frequency control of filter and the like in which the parameter must be varied continuously in a limited range.

(4) The embodiment can be modified such that the pitch-bend width can be freely set by the user or it is preset in advance. In this case, the pitch-bend width is pre-stored in the preset area shown in FIG. 27, while the change thereof made by the user is made with respect to the tone color to be set in the custom area.

The above is the description of the present invention. Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

a first musical tone signal generating means for generating a first musical tone signal;

a second musical tone signal generating means for generating a second musical tone signal;

a manual-operable means, which can be manually operated by a performer so that arbitrary values can be continuously set;

first and second maximum-parameter-variation setting means for setting maximum-parameter-variations, corresponding to a maximum value which can be set by said manual-operable means, for said first and second musical tone generating means independently; and parameter designating means for designating musical tone parameters of said first and second musical tone generating means on the basis of the value set by said manual-operable means and the maximum-parameter-variations.

2. An electronic musical instrument as defined in claim 1 wherein there are provided first and second modes, one of which can be arbitrarily selected by said parameter designating means, so that in the first mode, said parameter designating means sets the musical tone parameter of said first musical tone signal generating means on the basis of the maximum value set by said first maximum-parameter-variation setting means, and said parameter designating means also sets the musical tone parameter of said second musical tone signal generating means on the basis of the maximum value set by said second maximum-parameter-variation setting means, while in the second mode, on the basis of one of the maximum values set by said first and second maximum-parameter-variation setting means which is selected by a predetermined condition, said parameter designating means sets the musical tone parameters of said first and second musical tone signal generating means.

3. An electronic musical instrument as defined in claim 1 wherein the value set by said manual-operable means to be operated by the performer concerns a pitch-bend-effect.

4. An electronic musical instrument as defined in claim 1 wherein said manual-operable means is a wheel-type control having a shape which can easily held and rotated by the performer.

5. An electronic musical instrument comprising:

a first musical tone signal generating means for generating a first musical tone signal;

a second musical tone signal generating means for generating a second musical tone signal;

a manual-operable means, which can be manually operated by a performer so that an arbitrary value can be continuously set;

parameter designating means for designating a value of maximum-parameter-variation in a range determined by maximum-parameter-variations of first and second tone colors;

first and second maximum-parameter-variation setting means for setting maximum values each adjusted by an adjusting means provided for said first and second musical tones.

6. An electronic musical instrument as defined in claim 5 wherein there are provided first and second modes, one of which can be arbitrarily selected by said parameter designating means, so that in the first mode, said parameter designating means sets the musical tone parameter of said first musical tone signal generating means on the basis of the maximum value set by said first maximum-parameter-variation setting means, and said parameter designating means also sets the musical tone parameter of said second musical tone signal generating means on the basis of the maximum value set by said second maximum-parameter-variation setting means, while in the second mode, on the basis of one of the maximum values set by said first and second maximum-parameter-variation setting means which is selected by a predetermined condition, said parameter designating means sets the musical tone parameters of said first and second musical tone signal generating means.

* * * * *